US012472443B1

(12) United States Patent
Amar

(10) Patent No.: US 12,472,443 B1
(45) Date of Patent: Nov. 18, 2025

(54) CAPSULED BALLOONS AND INFLATION DEVICES FOR SUCH CAPSULED BALLOONS

(71) Applicant: HAPPY LOON LTD., Netanya (IL)

(72) Inventor: Israel Amar, Tel Aviv (IL)

(73) Assignee: HAPPY LOON LTD., Netanya (IL)

( * ) Notice: Subject to any disclaimer, the term of this patent is extended or adjusted under 35 U.S.C. 154(b) by 0 days.

(21) Appl. No.: 19/050,273

(22) Filed: Feb. 11, 2025

Related U.S. Application Data

(60) Provisional application No. 63/744,543, filed on Jan. 13, 2025, provisional application No. 63/683,440, filed on Aug. 15, 2024.

(51) Int. Cl.
*A63H 27/10* (2006.01)

(52) U.S. Cl.
CPC ..... *A63H 27/10* (2013.01); *A63H 2027/1033* (2013.01)

(58) Field of Classification Search
CPC ..... A63H 27/10; A63H 2027/1033
See application file for complete search history.

(56) References Cited

U.S. PATENT DOCUMENTS

| | | | | |
|---|---|---|---|---|
| 3,191,801 | A | 6/1965 | Standish | |
| 3,380,490 | A | 4/1968 | Ellenberg et al. | |
| 3,414,123 | A | 12/1968 | Litt et al. | |
| 3,561,579 | A | 2/1971 | Allison | |
| D220,781 | S | 5/1971 | Levin | |
| 3,580,303 | A | 5/1971 | Roberge | |
| 3,616,569 | A | 11/1971 | Litt et al. | |
| 3,616,823 | A | 11/1971 | Dello | |
| 3,670,860 | A | 6/1972 | Allison | |
| 3,911,974 | A | 10/1975 | Kuykendall | |
| 4,088,161 | A | 5/1978 | Ikemoto | |
| 4,094,347 | A | 6/1978 | Ikemoto | |
| 5,370,161 | A | 12/1994 | Shafer | |
| 5,573,437 | A * | 11/1996 | Van Dyke | B42D 15/045 446/79 |
| 6,892,770 | B2 | 5/2005 | Ratermann | |
| 10,699,513 | B2 * | 6/2020 | Jeon | G07F 11/00 |
| 2007/0249259 | A1 * | 10/2007 | Pham | A63H 33/22 446/224 |
| 2009/0266838 | A1 | 10/2009 | Yao | |
| 2011/0316275 | A1 | 12/2011 | Wainohu et al. | |

FOREIGN PATENT DOCUMENTS

| | | | |
|---|---|---|---|
| CN | 108922037 B | | 2/2021 |
| KR | 20230097427 A | * | 7/2023 |
| WO | 2010143931 | | 12/2010 |
| WO | 2023/058122 | | 4/2023 |

OTHER PUBLICATIONS

Translation of KR 10-2023-0097427 (Year: 2023).*

* cited by examiner

*Primary Examiner* — Jason K Niesz
(74) *Attorney, Agent, or Firm* — The Law Office of Joseph L. Felber

(57) ABSTRACT

A system includes a capsuled balloon and an inflation device. The capsuled balloon includes a balloon encased within a capsule while an inflation tube of the balloon remains outside of the capsule, and the inflation device includes an interface that opens out of the device along an axis and comprises locking arms. The capsuled balloon at its boundary region is located within the interface with the inflation tube oriented generally along the device's axis, and the locking arms of the interface engage the inflation tube in order to fix it in place.

22 Claims, 31 Drawing Sheets

CAPSULED BALLOONS AND INFLATION DEVICES FOR SUCH CAPSULED BALLOONS

TECHNICAL FIELD

Embodiments of the invention relate to capsuled balloons and inflation devices for same, and in particular inflatable capsuled balloons that open upon inflation.

BACKGROUND

Balloons are typically decorative and may be inflated by various types of gaseous. When filled with helium gas, which is lighter than air-such balloons may e.g. float and stay aloft for several hours to days.

Helium balloons can come in various shapes, sizes, and materials, typically including latex Balloons, which are made from natural latex rubber. These balloons are stretchy and come in a wide range of colors. They can be round, heart-shaped, or even animal-shaped.

Mylar type balloons are made from a type of metallic plastic film. These balloons have a shiny, reflective surface and can be printed with detailed designs, messages, or characters. They often come in shapes like stars, numbers, or popular cartoon characters.

Mylar balloons typically have an internal valve that prevents helium from escaping once they are inflated. This valve is designed to allow helium to enter the balloon but automatically closes off to stop the gas from leaking out. The valve is usually made from a thin, flexible plastic material and is built into the neck of the balloon.

Typically, helium balloons are sold either pre-inflated or as flat, uninflated balloons that the customer can inflate themselves.

In certain cases, helium balloons may be enclosed within a capsule, and dedicated devices that are provided can control the opening and the release the balloons from within their capsules.

WO2023058122 describes a gas injection device that injects gas into a balloon body that is accommodated within a balloon case. The balloon case is designed to open when a wedge is inserted into its deployment opening in order to allow the balloon case to be opened before gas is injected into the balloon.

SUMMARY

The following embodiments and aspects thereof are described and illustrated in conjunction with systems, tools and methods which are meant to be exemplary and illustrative, not limiting in scope.

In an embodiment there is provided a system comprising a capsuled balloon and an inflation device, the capsuled balloon comprising a balloon encased within a capsule while an inflation tube of the balloon projects out of the capsule at a boundary region of the capsule, the inflation device comprising an interface that opens out of the device along an axis and comprises locking arms, wherein in a fully engaged state of the system the capsuled balloon at its boundary region is located within the interface with the inflation tube oriented generally along the device's axis, and the locking arms of the interface engage the inflation tube in order to fix it in place.

In a further embodiment there is provided a method for inflating a balloon comprising the steps of: providing a capsuled balloon comprising a balloon encased within a capsule while an inflation tube of the balloon projects out of the capsule at a boundary region of the capsule, providing an inflation device comprising an interface that opens out of the inflation device along an axis and comprises locking arms, initially engaging the capsuled balloon with the inflation device by inserting the capsuled balloon at its boundary region into the interface with the inflation tube oriented generally along the device's axis, and then urging the locking arms of the interface to move and engage the inflation tube in order to fix it in place.

In yet a further embodiment there is provided a method for forming a capsuled balloon comprising the steps of: providing a sheet of material, providing a balloon comprising a neck region and an inflation tube located within the neck region while leaving an inflation port of the tube exposed outside of the balloon, folding the balloon onto itself and placing it upon the sheet of material, and then urging the sheet of material to form a capsule that substantially encloses the folded balloon therein while leaving the balloon's inflation port outside of the capsule.

In an embodiment there is provided a system comprising a capsuled balloon and an inflation device, the capsuled balloon comprising a balloon substantially encased in its deflated state within a capsule while an inflation tube of the balloon projects out of the capsule at a boundary region of the capsule, the inflation device comprising an interface and said interface comprises locking arms, wherein an engaged state of the system comprises: the capsuled balloon being engaged at its boundary region with the interface and the locking arms abutting and being pressed against the inflation tube in order to fix it in place.

Possibly, the interface opens out of the device along an axis and the inflation tube being oriented in the engaged state generally along the axis.

Typically, the interface opens out of the inflation device at a boundary and comprises a peripheral reference face that extends axially inwards from the boundary.

Typically, the reference face is adapted to at least partially surround the boundary region of the capsule in the engaged state of the system.

If desired, a shape of the reference face is generally similar to a shape of the boundary region.

Possibly, the inflation device comprises a movable inflation nozzle.

Optionally, the capsule is formed from a sheet of material, for example cardboard.

In certain cases, the capsule is formed by folding the sheet of material onto itself.

In other cases, the capsule is formed by rolling the sheet of material onto itself.

Possible, a loading mechanism is provide at the interface that is adapted trigger one or more events in a certain order to reach the engaged state of the system.

Optionally, the loading mechanism comprises a spring loaded lid.

If desired, the loading mechanism comprising flexible anchoring arms.

In an embodiment there is provided a method for inflating a balloon comprising the steps of: providing a capsuled balloon comprising a balloon substantially encased in its deflated state within a capsule while an inflation tube of the balloon projects out of the capsule at a boundary region of the capsule, providing an inflation device comprising an interface and said interface comprises locking arms, and reaching an engaged state between the capsuled balloon and the inflation device that comprises: engaging the capsuled balloon at its boundary region with the interface, and urging the locking arms of the interface to move and engage the inflation tube in order to fix it in place.

Possibly, the interface opens out of the device along an axis and the inflation tube being oriented in the engaged state generally along the axis.

Preferably, the inflation device comprises an inflation nozzle and inflating the balloon comprises first moving the inflation nozzle towards the inflation tube of the balloon so that it engages with an inflation port of the tube.

In an embodiment, there is provided a method for creating an inflation stem to be attached to a balloon, the method comprising the steps of: providing an inflation tube and an inflation port, and urging the inflation tube with one of its open ends leading onto a portion of the inflation port in order to assume an assembly forming the inflation stem.

Possibly, the method comprises a step of providing an elongated jig, and the urging the inflation tube onto the inflation port comprises first placing the inflation port at one end of the jig and then aligning the inflation tube with the jig and advancing it towards the inflation port along the jig.

Possibly, the inflation tube and inflation port are made from different materials.

If desired, the inflation port comprises a barb member and urging the inflation tube with one of its open ends leading onto a portion of the inflation port comprises urging it initially onto the barb member.

Possibly, the method comprises a step of applying heat to the inflation tube in a region where it is located upon the inflation port.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
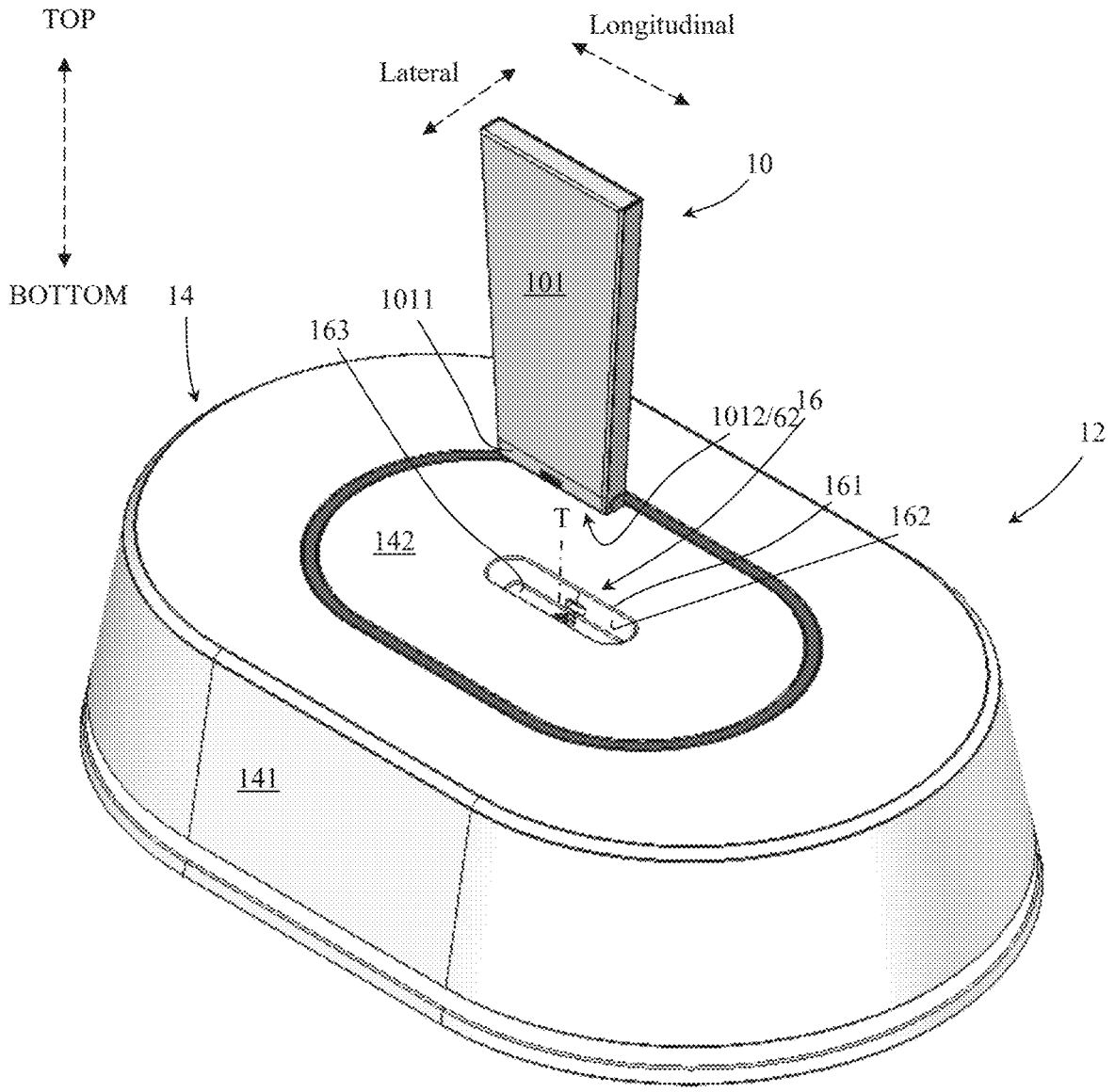
FIG. 1 schematically shows an embodiment of a generally narrow rectangular prism shaped capsuled balloon and an embodiment of an inflation device in accordance with the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1 schematically showing an embodiment of a narrow rectangular prism shaped capsuled balloon 10 and an embodiment of an inflation device 12 in accordance with the present invention.

Figure 2:
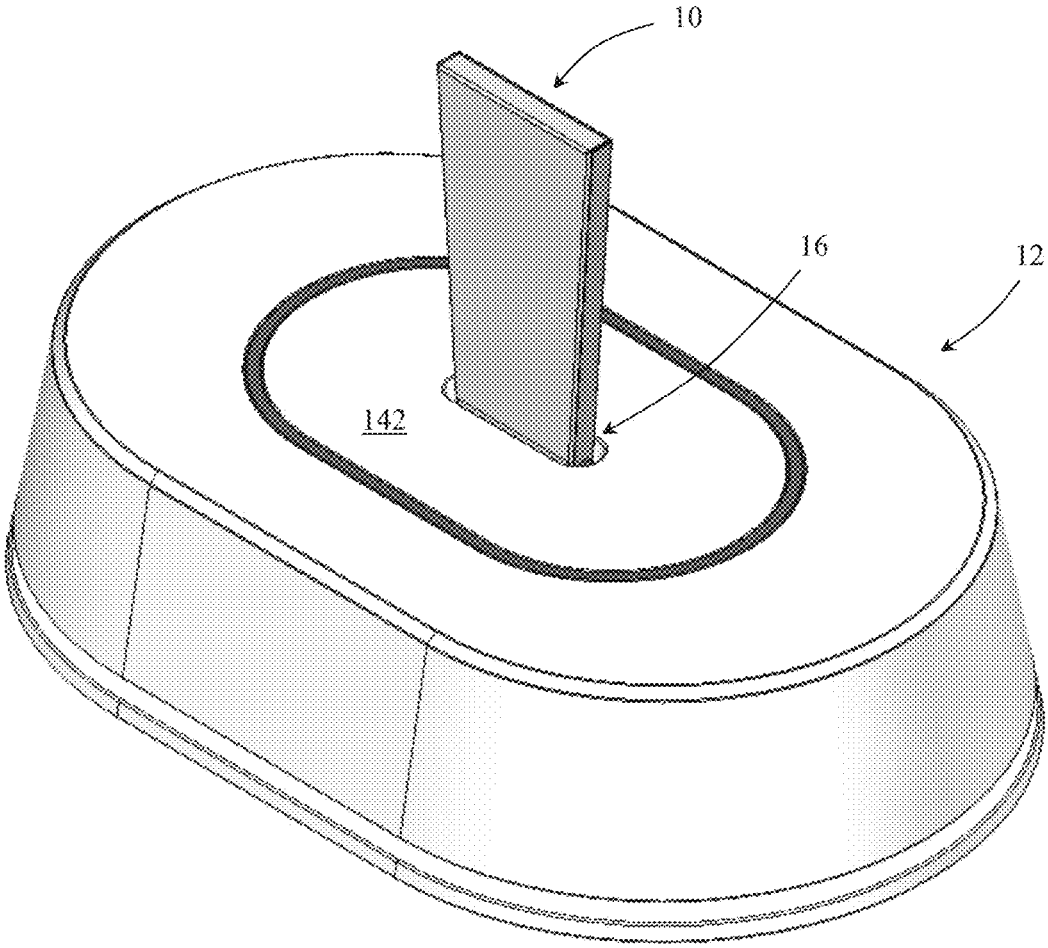
FIG. 2 schematically shows the capsuled balloon in an engaged state with an interface of the inflation device that is located within a top part of the device's outer housing.

The capsuled balloon 10, as best seen and discussed e.g. with respect to FIGS. 9 to 15, includes a capsule 101 that houses an inflatable balloon 200 therein (balloon 200 is not seen in FIGS. 1 and 2).

Balloons in the context of the present disclosure may be adapted to urge a casing or capsule of the balloon to open when inflated. Gaseous used for inflating balloons in the context of the present disclosure may be of various types, such as air or in some cases gaseous that are lighter than air.

In some cases e.g. the balloon may be a Helium balloon, such as of a Latex of Mylar type.

In certain cases the balloon while being inflated is adapted to 'pop', 'burst' and/or 'break' open the capsule so that the balloon can be freed to exit the capsule, and in cases where the gaseous are lighter than air (such as helium), to float upwards when released.

The inflation device 12 can be seen having an outer housing 14 here optionally formed from main and top parts 141, 142. Within the top part 142 the inflation device can be seen having an interface 16 formed as an opening or region through which fluid communication and coupling to the capsuled balloon 10 can be provided. In other words, the interface 16 may be defined as a cavity that opens out of the inflation device 12 at the housing's top part 142 along an axis T.

The interface 16 can be seen having an upper boundary 161 where it opens out from the inflation device and a peripheral reference face 162 that extends down from boundary 161 towards a floor 163 of the interface. The boundary and reference faces 161, 162 are designed to have a shape, which generally corresponds to a lower boundary region 1011 of the capsule 101 adjacent its lower side 1012 that is designed to face and engage with the interface. A lower terminal face 62 of the capsule designed to face the interface may be part of the capsule's lower side 1012.

In other words, the boundary and in particular the reference face 162 serves as a reference for the orientation and positioning of the inserted capsuled balloon, and acts as a guide to ensure that the capsuled balloon is correctly oriented within the interface.

It is noted that the directional terms "down", "below" and "bottom" (and derivatives thereof) define identical directions; as well as "up", "above" and "top" (and derivatives thereof) define identical directions.

When the capsuled balloon 10 is engaged with the interface 16 at its boundary region 1011, interaction between the interface's boundary 161 and reference face 162 and the capsuled balloon's boundary region 1011 is adapted to suitably locate the capsuled balloon within the interface so that further actions relating to the inflation of the balloon can take place.

Attention is drawn to FIG. 2 schematically showing the capsuled balloon 10 in an engaged state with the inflation device's interface 16.

Figure 3:
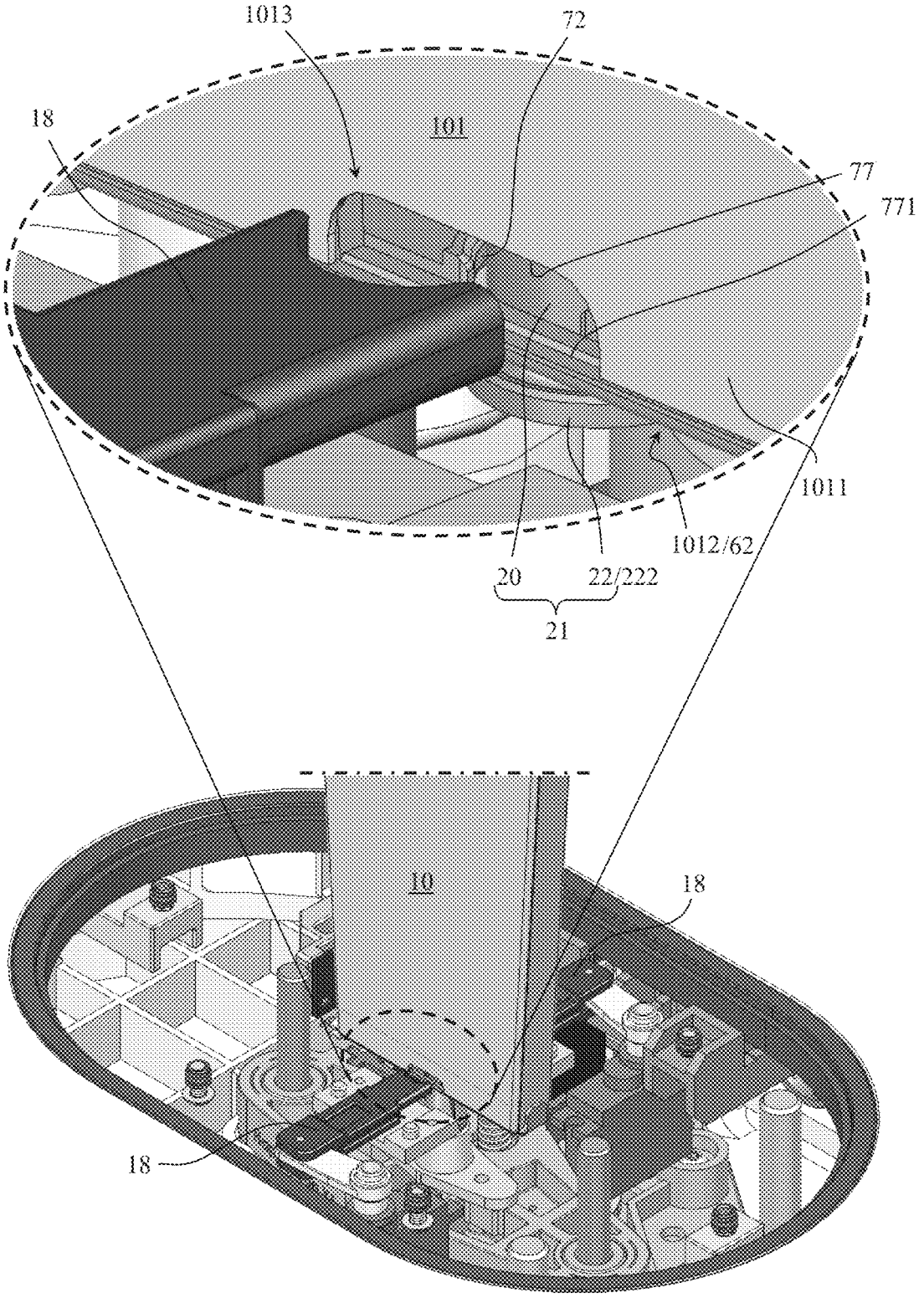
FIG. 3 provides a closer view of FIG. 2 with the device's top part being removed revealing internal mechanisms of the device, and in particular locking arms of its interface that can be seen in the enlarged upper section in a disengaged state with an inflation stem of the capsuled balloon.

With attention additionally drawn to FIG. 3, a closer view of the region where the capsuled balloon 10 engages the interface 16 can be seen. Here the device's top part 142 is removed revealing internal mechanisms of the inflation device including a pair of locking arms 18 of its interface 16.

In the context of this disclosure, the components involved in inflating capsuled balloons-including the inflation device's interface, locking arms, fluid delivery conduits, controllers, actuators (and the like)—may collectively be referred to as an Inflation Handling System (HIS).

With attention drawn to the enlarged upper section of this figure it can be seen that the capsuled balloon 10 has an inflation stem 21, which includes an inflation port 22 that is located here immediately below the capsule's narrow end face at its lower side 1012. The inflation port 22 serves as an opening through which e.g. helium, or other gaseous can be introduced to inflate the balloon.

In this example, the inflation stem's inflation port 22 is located at an end of an inflation tube 20 of the inflation stem, which communicates incoming gaseous towards the interior of the balloon. Such tube 20 may be integrated or formed as part of the balloon, and may typically be formed from relative durable materials such as plastic.

Attention is directed to FIGS. 24A to 24F, which schematically illustrate an embodiment of an inflation stem 21. In this design, the inflation tube 20 and the inflation port 22 are constructed as two distinct components that are assembled to create the complete inflation stem 21.

The materials used for the inflation tube 20 and the inflation port 22 may differ. For instance, the inflation tube 20 could be made from a softer and/or more flexible material compared to the inflation port 22. As a non-limiting example, the inflation tube 20 might be constructed from polypropylene (PP) or similar materials, while the inflation port 22 could be made from ABS (Acrylonitrile Butadiene Styrene), Polycarbonate or equivalent materials.

Figure 24A:
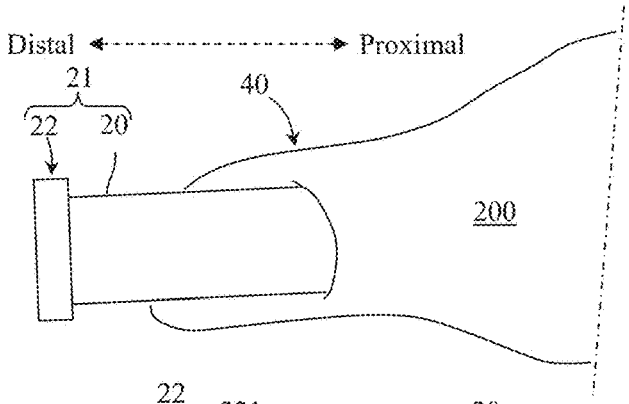
FIGS. 24A to 24H schematically show an embodiment of an inflation stem of the present invention and possible methods for forming this inflation stem.
Figure 24B:
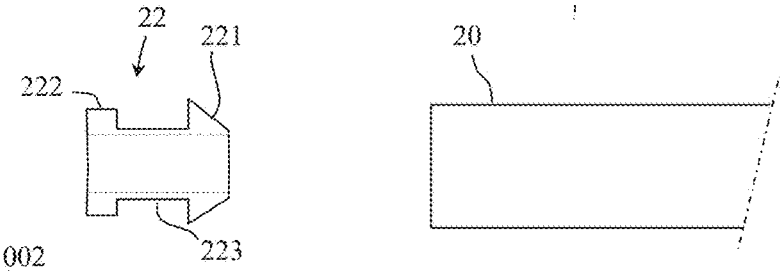
Figure 24C:
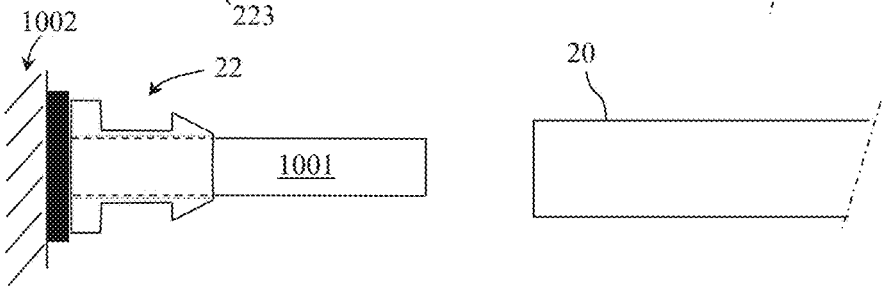
Figure 24D:
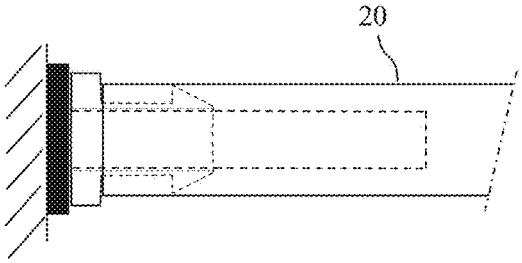
Figure 24E:
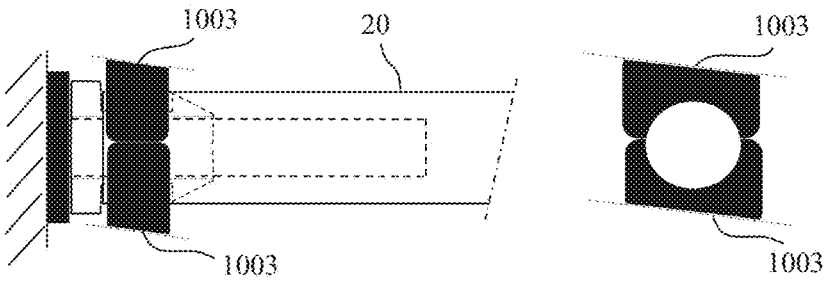
Figure 24F:
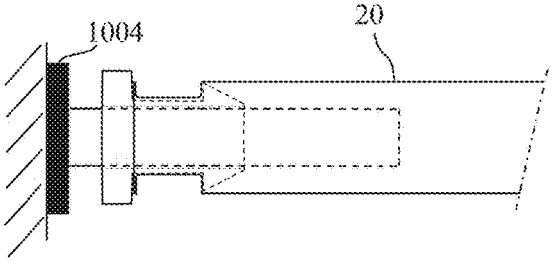
Figure 24G:
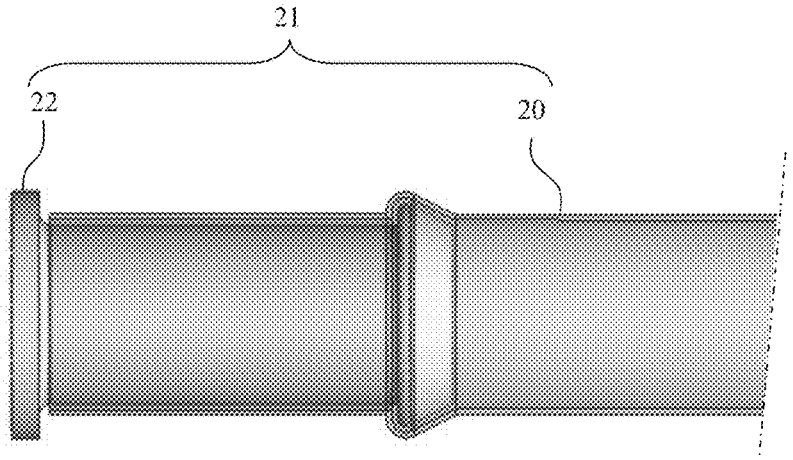

In FIGS. 24A and 24G, the inflation stem 21 is depicted in its assembled state, where a raised rim of the inflation port 22 protrudes out of a distal end of the inflation tube 20. The inflation stem is designed to attach to a neck region 40 of a balloon 200, with the inflation port 22 (in particular at its raised rim) being positioned distally outside the balloon.

Figure 24H:
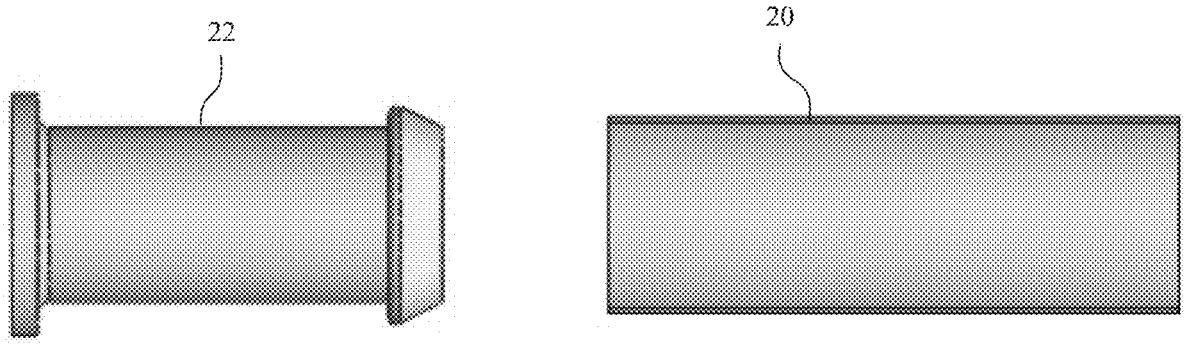

In FIGS. 24B and 24H, the inflation stem 21 is illustrated in a disassembled state, where the inflation port 22 and the inflation tube 20 are shown separated. In this example, the inflation port 22 features a barb member 221 on its proximal side that is designed to engage with the distal open end of the inflation tube 20.

The barb member 221 is one example for ensuring a secure connection by creating a firm grip on the interior of the inflation tube 20, preventing it from slipping off. This secure hold is achieved through the ridges or protrusions on the barb member's periphery, which provide resistance to pulling forces.

The inflation port 22 accordingly also features a raised rim here indicated by numeral 222 at its distal end, positioned farthest from the balloon, and a possible peripheral recessed region 223 located between the rim 222 and the barb member 221.

FIGS. 24C to 24F illustrate potential steps involved in assembling the inflation port 22 to the inflation tube 20, resulting in the fully assembled inflation stem 21.

In FIG. 24C, the process may begin with the inflation port 22 being threaded onto a guiding rod or jig 1001, which is designed to pass through its internal passage. The guiding rod/jig 1001 may be constructed from metallic material, such as aluminum. The inflation port 22 may be positioned at the distal end of the jig, with its barb member oriented toward the proximal side. The distal end of the jig 1001 as seen may be securely supported by a firm base 1002.

Meanwhile, the inflation tube 20 may be aligned with the guiding rod 1001, ensuring that its distal opening is opposite the proximal end of the jig 1001.

As depicted in FIG. 24D, the inflation tube 20 may be advanced, with its distal end leading, onto the guiding rod/jig 1001, which passes through the tube's internal passage.

As the inflation tube 20 moves along the jig 1001, it engages with the inflation port 22, aligning such that the tube overlaps the inflation port's barb member 221 and recessed region 223. The guiding rod 1001 assists in the alignment during this interaction.

FIG. 24E illustrates a subsequent possible step where the inflation tube 20 may be securely attached to the inflation port 22 using heating elements 1003 applied to the area of the inflation tube 20 that overlaps the recessed region 223 of the inflation port 22. The heat deforms the inflation tube in this area, allowing it to conform to the recessed shape of the inflation port 22.

In some instances, at least a portion of the jig 1001 may feature an internal passage (not depicted) that opens radially outward in an area where the inflation port 22 is intended to be positioned. Additionally, the inflation port 22 may be configured with radially extending apertures (not illustrated) in regions where the inflation tube 20 is designed to fit snugly, such as within its recessed region 223. Consequently, to ensure the inflation tube 20 conforms to the shape of the inflation port 22, suction may be applied to draw the tube into place on the port, for example, during or prior to the use of the heating elements 1003, as shown in FIG. 24E.

Finally, as shown in FIG. 24F, a possible ejector 1004, positioned between the inflation port 22 and the base 1002, may be used to urge the assembled inflation stem off the jig, completing the assembly process.

Attention is drawn back to the enlarged upper section of FIG. 3 showing an opening 1013 that is formed within the capsule 101 adjacent it's lower side 1012 and/or within its lower boundary region 1011. Each such opening 1013 as seen may be surrounded by a border 77 that may extend also along its lower side 771. The section of border 77 along the lower side 771 of the opening 1013, may be part of the capsule's lower terminal face 62, through which an opening 72 is formed as seen in FIG. 3 in order to allow the inflation tube 20 to be exposed to outside of the capsule.

Such an opening 1013 may be designed to be located in the capsule 101 opposite each one of the locking arm 18 of the device's interface 16, and therefore in this example an opening 1013 may be formed in each lateral side of the capsule 101, resulting in a total of two such openings 1013 being formed in this capsule.

Figure 4:
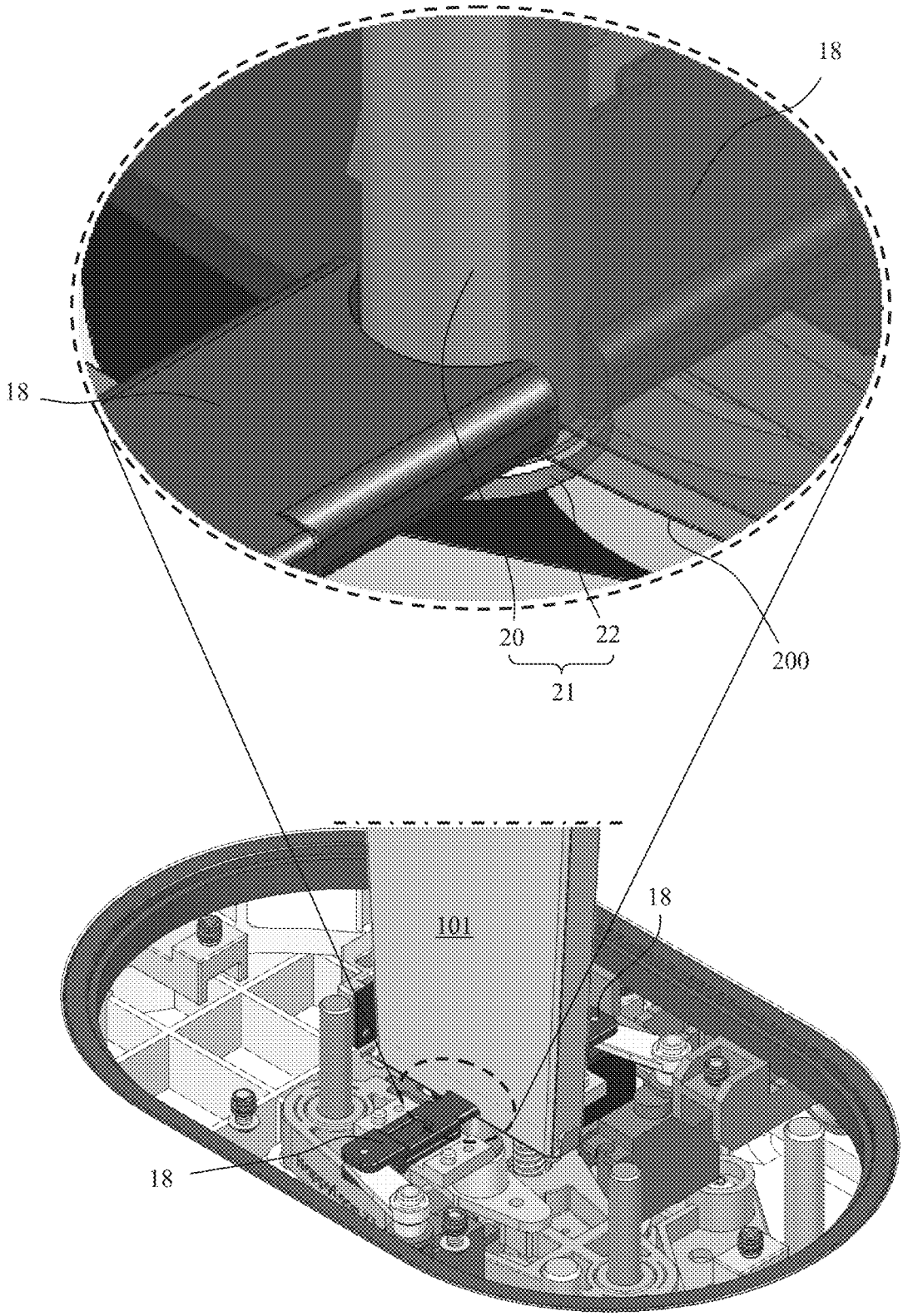
FIG. 4 provides is a similar view to the one seen in FIG. 3, however with the locking arms being shown in its enlarged upper section in an engaged state with the stem's inflation port of the capsuled balloon.

In FIG. 4, the locking arms 18 can be seen being urged to engage and press against the inflation tube 20 of the balloon adjacent to inflation port 22 in order to securely fix the inflation port 22 in place and by that enhance the engaged state of the capsuled balloon and inflation device. Each locking arm 18 is linked in this example via a crank arm 23 with a respective motor shaft 25, which translates the motor's rotational motion into linear or reciprocating motion, depending on the motor's rotational direction.

In the enlarged upper section of FIG. 4 the capsule 101 has been removed for better visibility of the fixation of the locking arms 18 against the inflation tube 20 adjacent inflation port 22.

With the removal of the capsule 101, visibility has also been provided in this enlarged upper section to a portion of the balloon 200 that is here seen in a folded state.

As seen in the lower side of FIG. 4, it is understood that each locking arm 18 passes through a respective one of the openings 1013 formed within the lateral sides of the capsule 101, in order to reach such engagement with the inflation tube 20.

Figure 5:
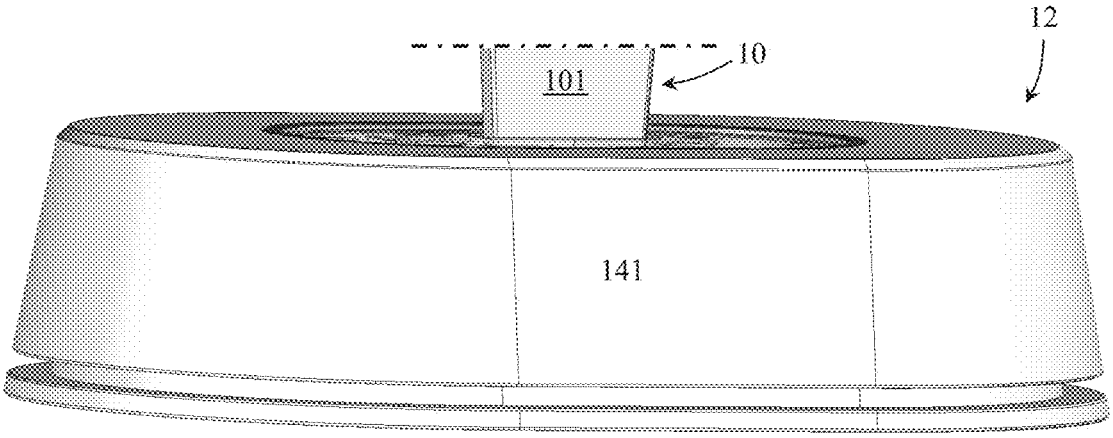
FIGS. 5 and 6 schematically show side views of the inflation device and the capsuled balloon in its engaged state, with a portion of the devices outer housing being removed revealing some parts of its interior mechanism from this side.
Figure 6:
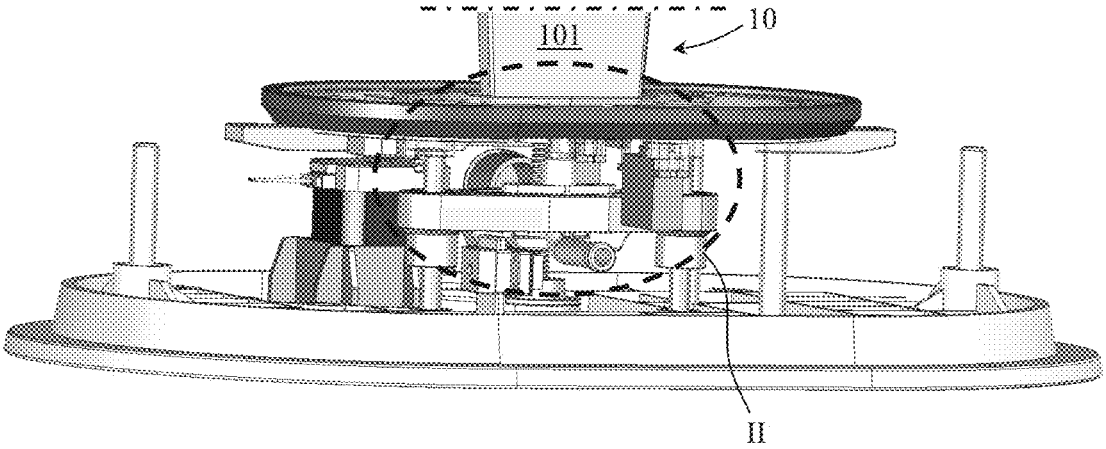

Attention is drawn to FIGS. 5 and 6 schematically showing lateral side views of the inflation device 12 and the capsuled balloon 10 in its engaged state, with a portion of the devices outer housing 14 being removed revealing some parts of its interior mechanism from this lateral side.

Figure 7:
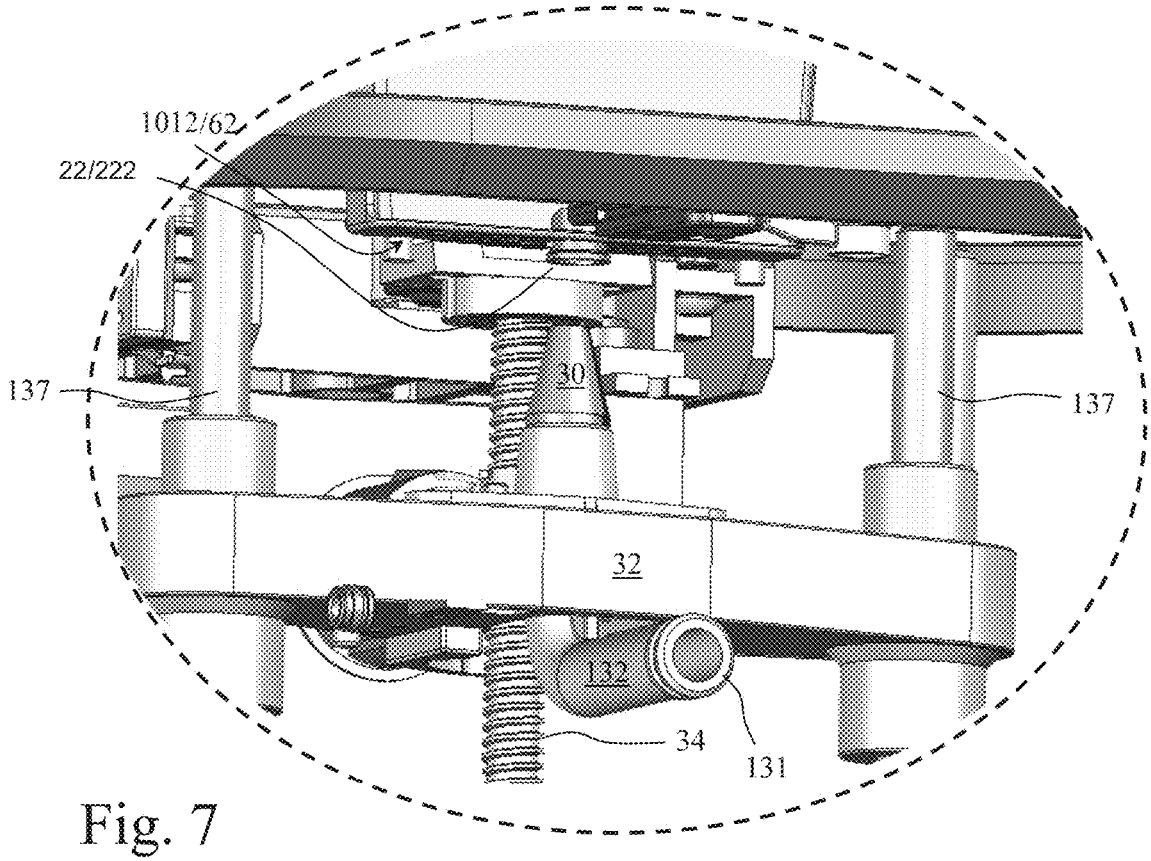
FIGS. 7 and 8 schematically show an inflation nozzle of the device in respective decoupled and coupled states with the inflation port of the balloon.
Figure 8:
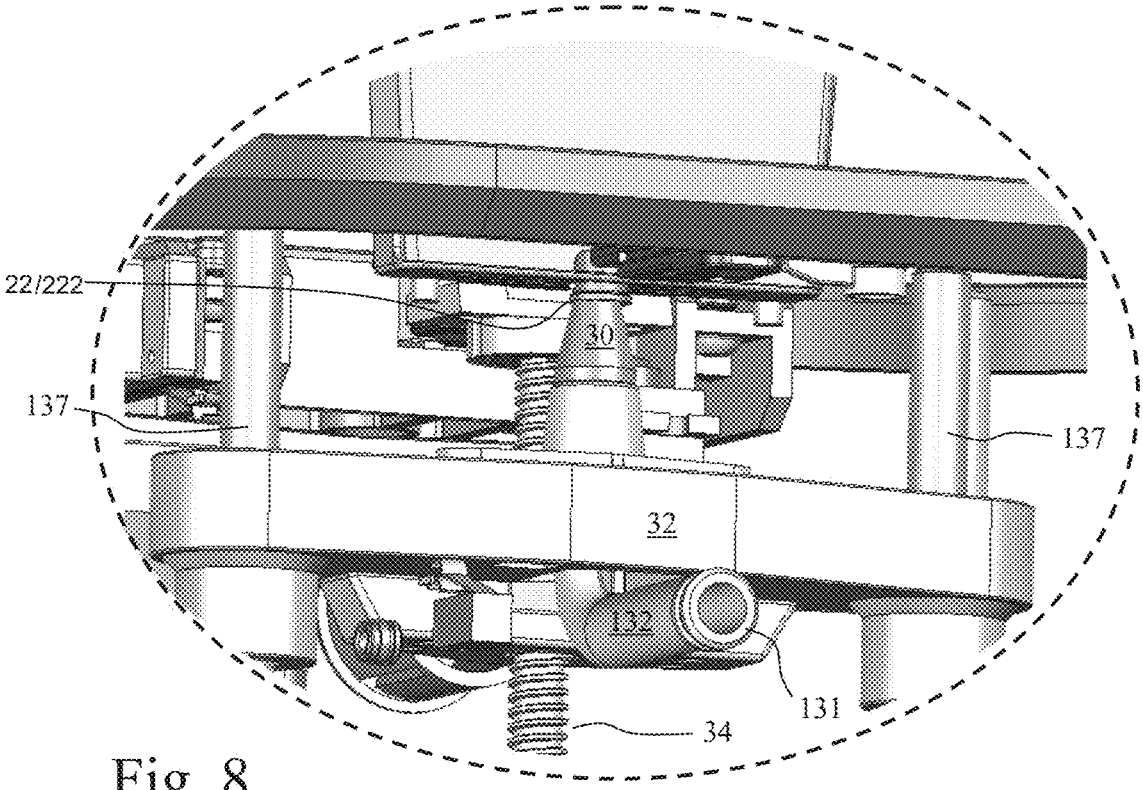

With attention drawn to FIGS. 7 and 8, section II indicated in FIG. 6 is seen enlarged, revealing an inflation nozzle 30 of the device in respective decoupled and coupled states with the inflation port 22 of the balloon.

In this example, the inflation nozzle 30 is fixed to a bed 32 that can be controlled to move axially up or down along guide rods 137 via a driving screw 34 in order to couple and decouple with the inflation port 22 of the balloon.

An internal gas source (not shown) may be located within the inflation device 12 in communication with an open end 131 of a pipe 132 that is connected to the inflation nozzle 30—in order to inflate upon demand a balloon that is engaged with the inflation device's interface 16.

The internal gas source may be a portable and/or disposable gas container. In certain cases, an external gas source located outside of the device may be used in addition to or instead of the internal gas source.

Preferably, inflation of the balloon may typically occur after the locking arms 18 initially engage with the inflation stem's inflation tube 20 in order to secure it in place for the inflation process as the inflation nozzle 30 is pressed against the inflation port 22. The inflation tube 20 can be secured by positioning the locking arms 18 above the peripheral raised rim 222 of the inflation stem. This setup ensures that when the inflation nozzle 30 exerts upward axial pressure on the inflation port 22, the locking arms 18 also engage the raised rim 222 from above. This engagement prevents the inflation stem from moving upward, thereby allowing the inflation process to proceed efficiently.

A controller (not shown) of the inflation device may control the inflation of the balloon to continue until the balloon reaches an inflated state (possibly pre-defined inflated state), which may include the balloon 'popping', 'bursting' and/or 'breaking' open the capsule.

Figure 22C:
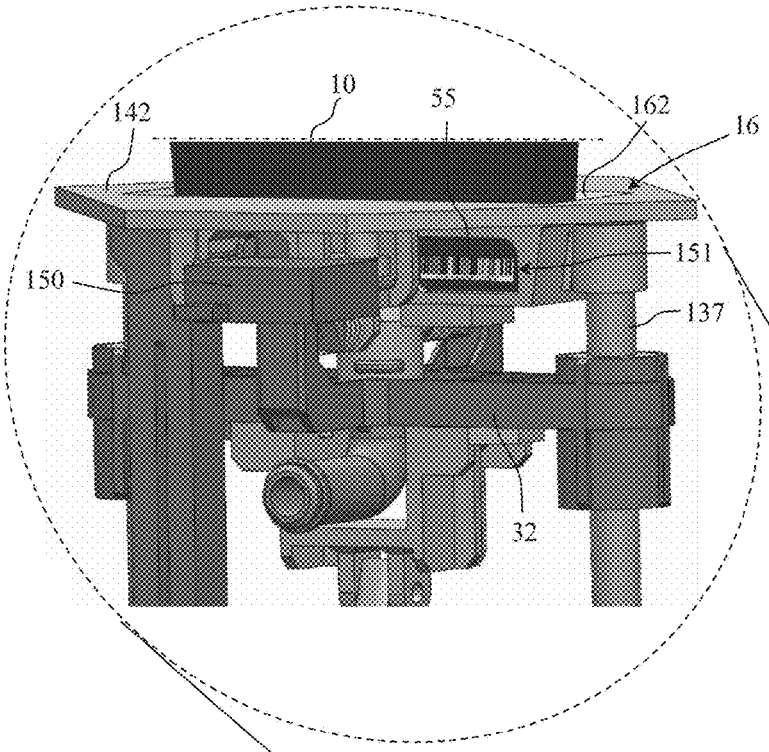
FIGS. 22A to 22C, 23A to 23D, and 29A to 29C schematically show portions of internal mechanisms of an inflation device in accordance with various embodiments of the present invention.
Figure 22B:
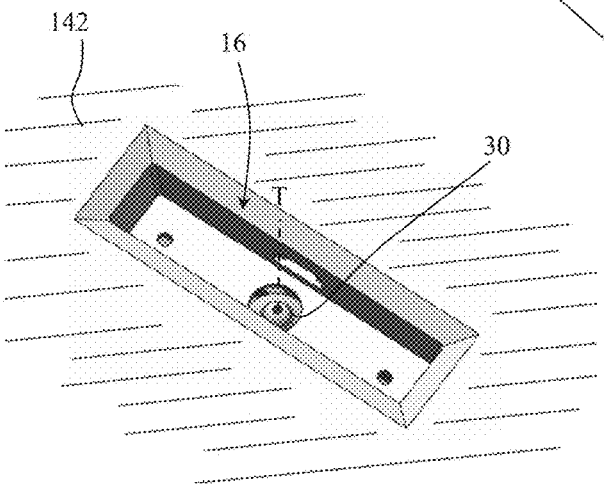
Figure 22A:
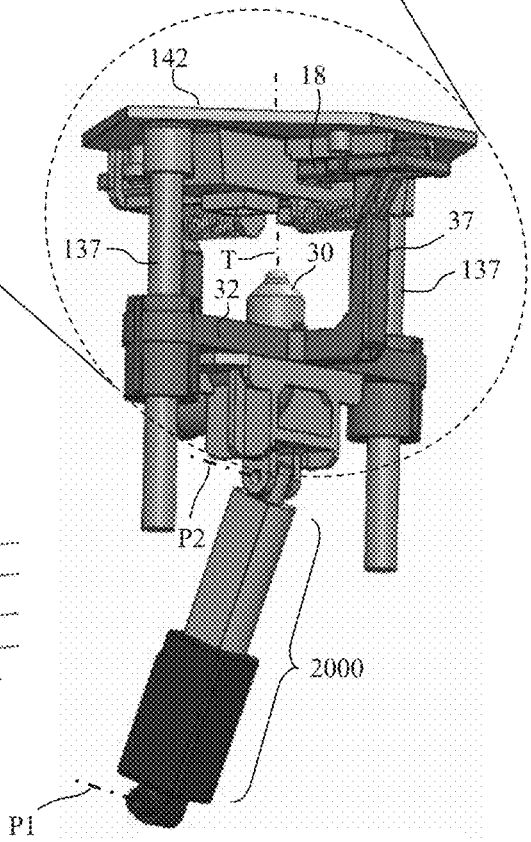

The embodiment illustrated in FIG. 22 showcases the use of a barcode reader 150 to scan a barcode 55 that may be located at the lower boundary of a capsule 10 positioned within the inflation device's interface 16. A window 151 may be incorporated into a portion of the interface's reference face 162, allowing a clear line of sight to the barcode. Such a barcode may contain information about the balloon encased within the capsule, such as its type, dimensions, and other relevant details. This data may enable the device's controller e.g. to configure parameters, such as the optimal inflation time, to ensure the balloon reaches full inflation without over-expanding and bursting. Notably, such a barcode reader may be integrated into all embodiments covered by this disclosure.

When such an inflated state is reached, the controller may urge the locking arms 18 to slightly retreat from the position where they hold onto the inflation tube, to an intermediate position where each such locking arm 18 may still be located above the lower side 771 that borders its respective opening 1013 from beneath.

The balloon, in particular in the case where it is inflated with gas that is lighter than air (e.g. helium), may then be released to float upwards while its capsule remains attached to the inflation device via the locking arms 18 that are still kept located within each one of its openings 1013.

Possibly, the inflation nozzle 30 may be controlled to be urged slightly upwards to assist in the detachment of the balloon from its capsule. In certain cases such assistance in detachment may include urging in this possible example the wider inflation port 22 through a slightly smaller sized opening 72 that may be formed within the capsule's lower terminal face 62 at its lower side 1012 and through which the inflation tube 20 in this example extends.

Attention is drawn to FIGS. 22A to 22C and 23A to 23D revealing portions of an internal mechanism of an embodiment of an inflation device that may have an exterior appearance, such as the appearance of the inflation device 12 seen in FIGS. 1, 2 and 5. Such an internal mechanism is typically substantially concealed within an outer housing, such as the outer housing 14 seen in FIGS. 1, 2 and 5, which has here been mostly removed.

In FIGS. 22A to 22C and 23A to 23D, a top part 142 of the outer housing can be seen remaining in which an interface 16 of the inflation device is formed. The interface 16 is formed as an opening or region through which fluid communication and coupling to a capsuled balloon 10 can be provided. In other words, the interface 16 may be defined as a cavity that opens out of the inflation device at the housing's top part 142 along an axis T.

This embodiment of the inflation device employs a telescopic piston 2000 that facilitates controlled motion of its inflation nozzle 30 along an axial direction generally parallel to axis T. One end of the piston 2000 is coupled at a first pivot P1 to a fixed location within the device, providing a stable anchoring point while allowing rotational movement about pivot P1. The opposite end of the piston 2001 is coupled at a second pivot P2 to a movable a bed 32, which is guided to move axially along parallel guide rods 137 that extend generally parallel to axis T. The inflation nozzle 30 is fixed to the upper side of the bed 32.

The guide rods 137 are securely mounted within the device and serve to constrain the motion of the bed 32 to a precise linear path. The telescopic nature of the piston accommodates variations in the distance between the fixed pivot P1 and the movable bed 32 during operation, ensuring smooth and efficient motion transfer.

The bed 32 includes a pair of upwardly extending levers 37, and each lever 37 includes an inner wall 372 that in this embodiment extends vertically axially upwards to a slanted face 371 at its upper side. The slanted faces 37 diverge away from axis T as they extend upwards.

The internal mechanism of the inflation device can also be seen including a pair of locking arms 18 adjacent its interface 16, which are designed to engage and press against an inflation tube 20 of a capsuled balloon that is fitted to interface 16. Such engagement of the inflation tube 20 occurs adjacent the inflation stem's inflation port 22.

Each locking arm 18 includes an engagement member 181 that protrudes generally downwards from a portion of the arm that is relatively distal to the interface 16. Each engagement member 181 includes a laterally outward facing vertical stop 1812 that extends downwards to transition to a slanted surface 1811. The slanted surfaces 1811 converge towards axis T as they extend downwards.

A compression spring 39 pressed between each engagement member 181 and an inner support 191 is configured to urge its respective locking arm 18 laterally sideways away from the interface 16.

Figure 23A:
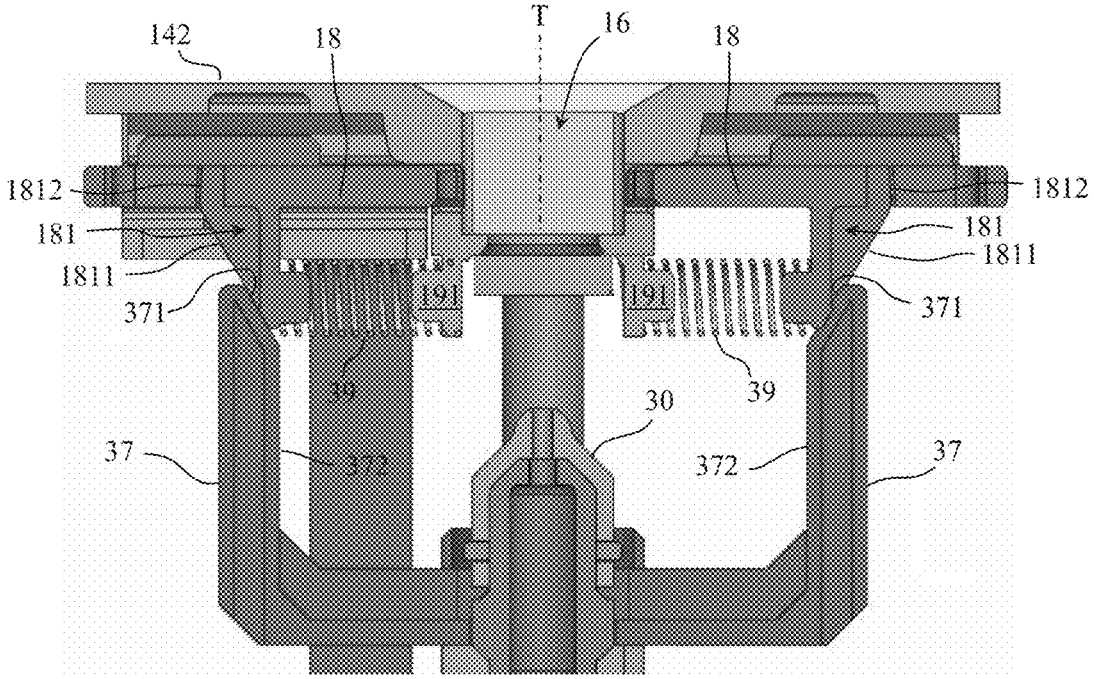
Figure 23B:
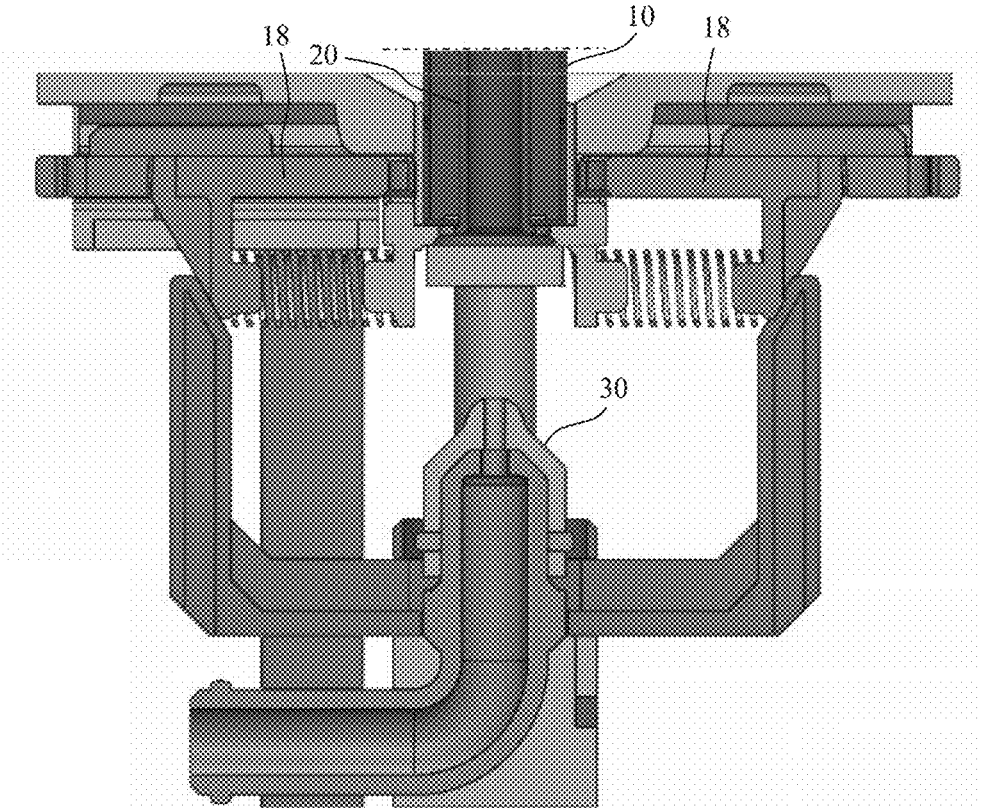
Figure 23C:
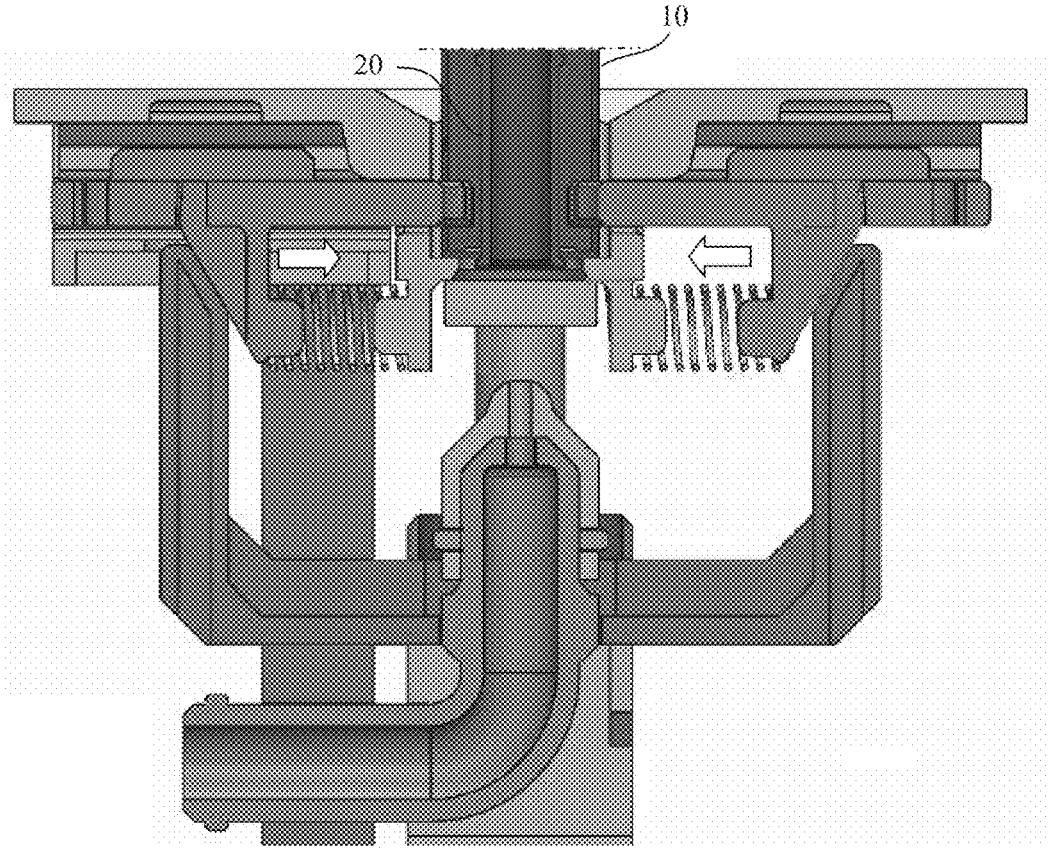

As seen in FIG. 23C, as the bed 32 moves axially upwards in response to motion applied by the telescopic piston 2000, the slanted faces 371 of the levers 37 bear against the slanted surfaces 1811 to urge the locking arms 18 laterally inwards towards the interface 16 against the biasing forces applied by the compression springs 39.

Figure 23D:
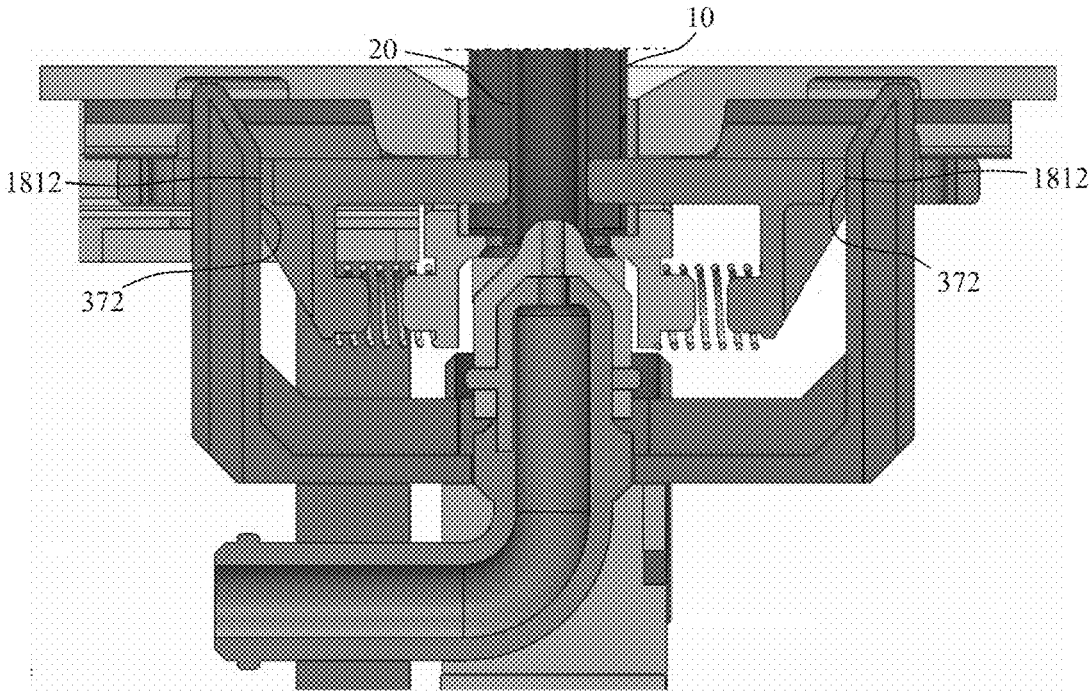

This motion continues as seen in FIG. 23D until the levers 37 lift upwards to a position where their vertical inner walls 372 engage the vertical stops 1812 and as a result lock the anchoring members 18 in a position where they engage against an inflation tube of a capsuled balloon fitted in the interface 16.

Moving the levers 37 downwards will allow the anchoring members 18 to be pushed back outwards by the compression springs 39 and by that release the grip against the inflation tube of the capsuled balloon.

Figure 29B:
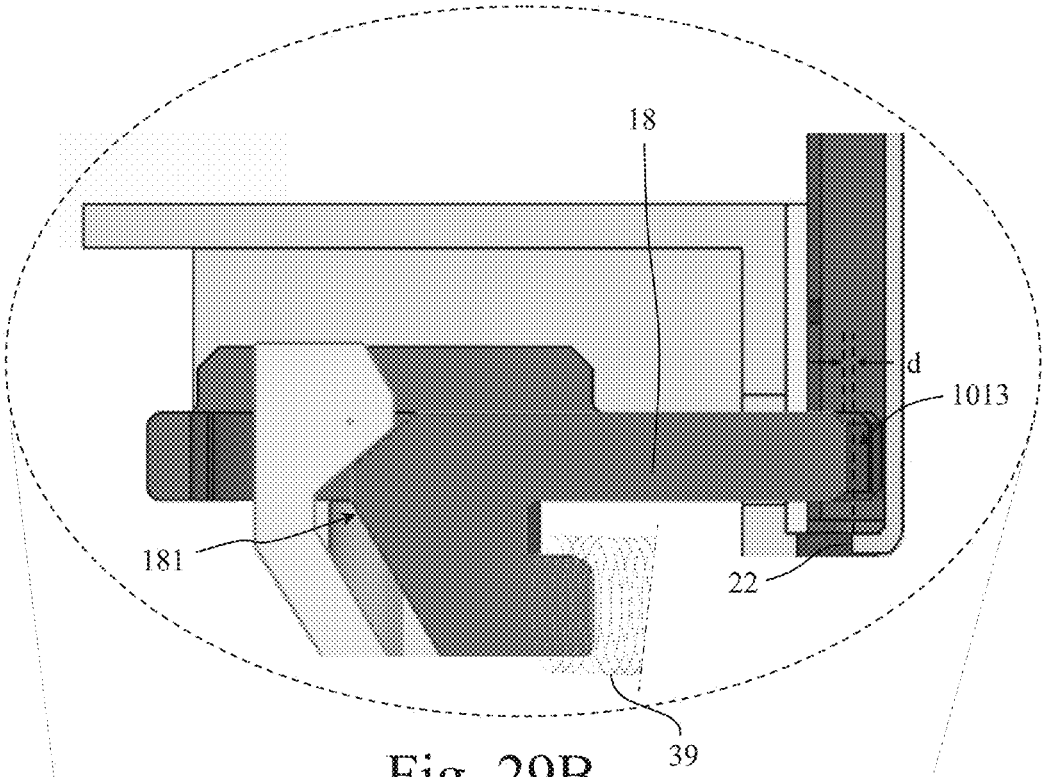
Figure 29A:
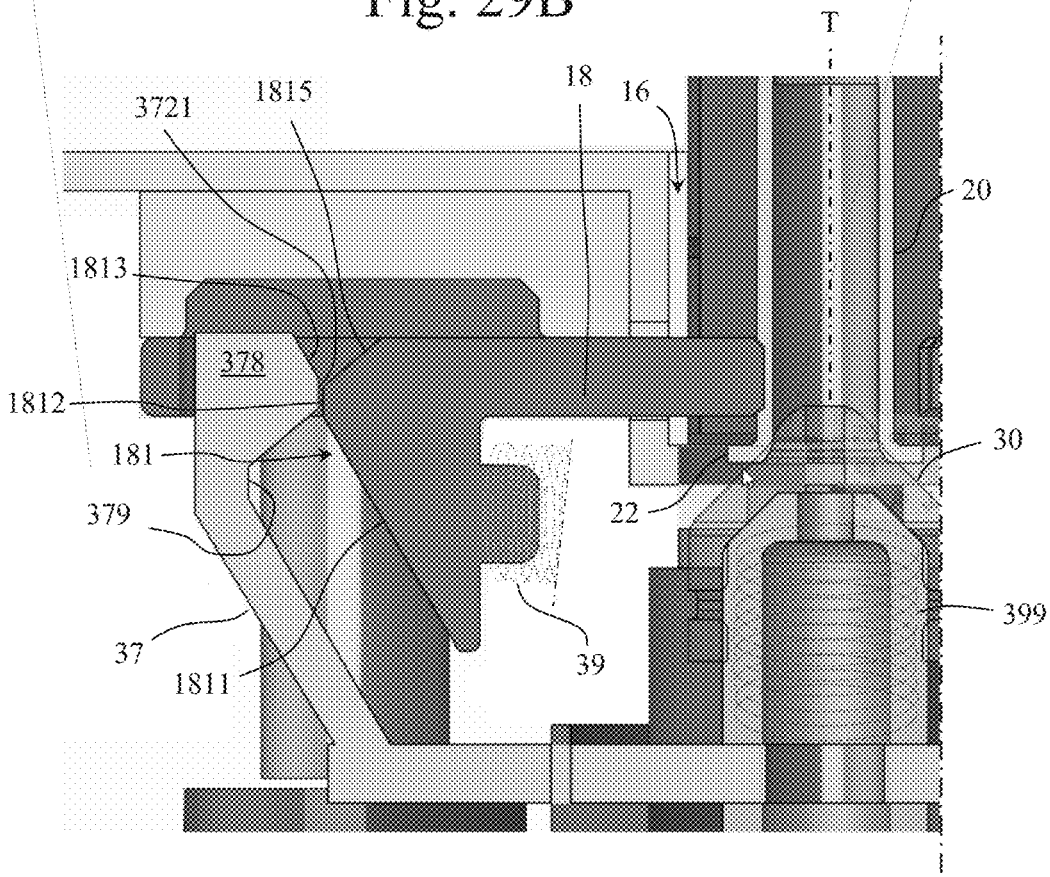

Attention is directed to the embodiment illustrated in FIGS. 29A and 29B, where the levers 37 (only one visible here) are seen slanting upward from the bed, away from axis T, towards a head 378 that extends toward axis T. The upper side of the head features a slanted inner surface 1813, which inclines upward and away from axis T, while a recess 379 is formed between head 378 and the inner side of lever 37.

Each engagement member 181 (only one visible here) comprises a laterally outward-facing vertical stop 1812 that extends downward and transitions into a slanted face 1811, which inclines toward axis T as it extends downward. In this embodiment, however, each engagement member 181 also features an inclined surface 1815 above the vertical stop 1812, which extends upward and toward axis T. Additionally, the inflation nozzle 30 is held under tension by a compression spring 399, which urges it upward.

As the bed moves axially upward in response to the motion applied by the telescopic piston 2000, the slanted faces 1813 of the levers 37 press against the slanted surfaces 1811, causing the locking arms 18 to move laterally inward toward the interface 16 against the opposing force exerted by the compression springs 39.

This motion continues until the levers 37 rise to a position where a vertical inner wall section 3721, located on the inner side of the head between surface 1813 and recess 379, engages the vertical stops 1812, effectively locking the locking arms 18 in place. As a result, they secure the inflation tube 20 of a capsuled balloon positioned in the interface 16.

In this locked position, the inflation nozzle 30 is also pressed against the capsuled balloon's inflation port 22, aided by the compression spring 399, which biases it against the port during the inflation process. Once the balloon is fully inflated, the levers 37 in this embodiment can be slightly raised to the position shown in FIG. 29B, allowing the locking arms 18 to move slightly outward. This outward movement positions their vertical stops 1812 within the recesses 379.

In this position, the inner ends of the locking arms 18 most proximal to the inflation tube 20 are still located within the openings 1013 formed at the lower side of the capsule, however spaced outwards by a distance 'd' so as to not be located above the inflation port 22 of the capsuled balloon. As a result, the inflated balloon 'popping', 'bursting' and/or 'breaking' open the capsule can be freed to exit the capsule and possibly float upwards when released while avoiding being caught up at the inflation port 22 by the locking arms that have been allowed to slightly retreat. The spring loaded inflation nozzle 30 bearing against the capsuled balloon's inflation port 22 assists in urging the freed balloon to lift and float upwards.

Figure 29C:
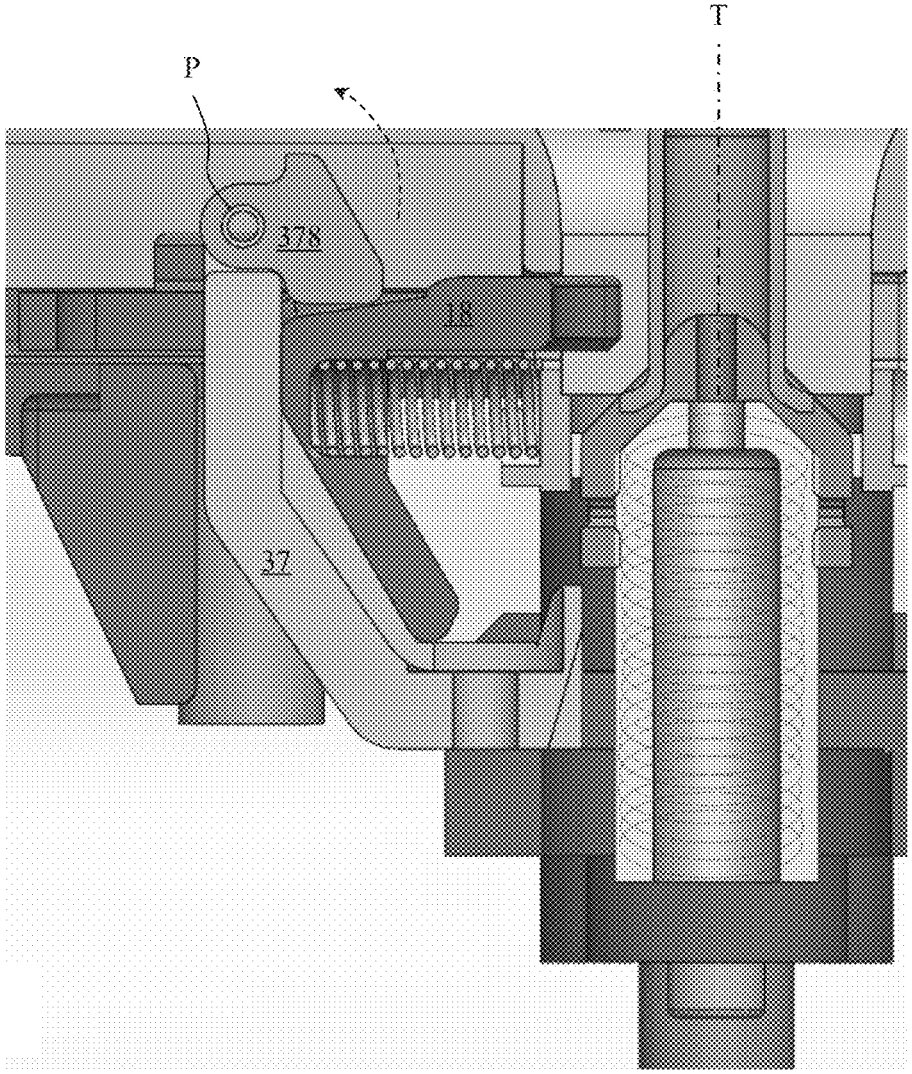

In FIG. 29C, an alternative configuration is illustrated in which each head 378 is hinged to its corresponding lever 37 via a pivot P. The heads are designed to be spring-loaded, naturally rotating toward axis T to assume the position shown in FIG. 29C. However, they can also rotate in the opposite direction (as indicated by the 'dashed' arrow) against the force of the spring (not shown) when the bed and levers move downward, disengaging from the capsule-preferably an empty capsule after the inflated balloon has been released.

Figure 9A:
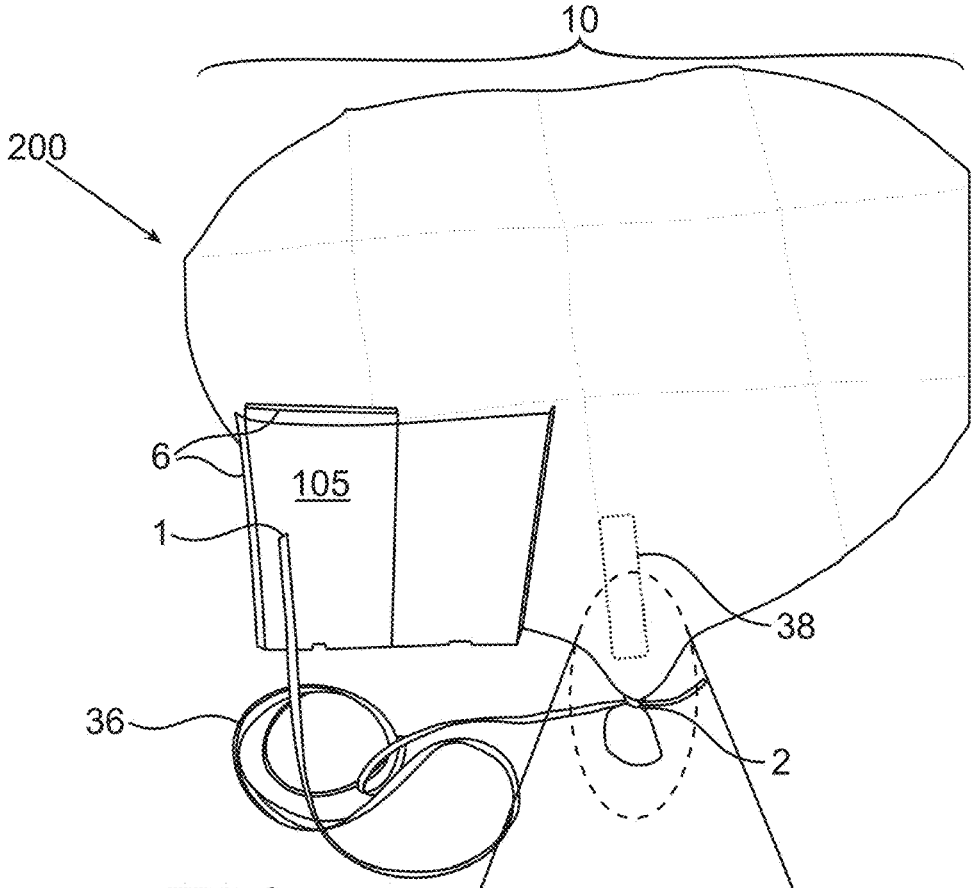
FIG. 9A schematically shows certain components used for forming an embodiment of a capsuled balloon, including a sheet of material used for forming an embodiment of a capsule and a balloon e.g. of a Mylar type.

Attention is drawn to FIG. 9A schematically showing certain components used for forming an embodiment of a capsuled balloon, including a balloon 200, a ribbon 36, and a sheet of material 105 that is used for forming an embodiment of a capsule.

In this example the sheet of material 105 used for the forming the capsule is cardboard and this sheet of material 105 can be folded upon itself to form the capsule for housing the balloon. Foldable edges 6 (only two being indicated in FIG. 9A) may be formed along the periphery of the sheet of material 105 to assist in the closing of the sheet of material 105 onto itself when forming the capsule about the balloon. In certain cases such foldable edges may be glued to edge regions or other foldable edges of the sheet of material 105 when forming a capsule.

It is noted that the capsules described in this disclosure are not limited to being made of cardboard; they may also be composed of other materials such as paper, polymers like nylon, blister bags, or similar or other alternatives.

Figure 20:
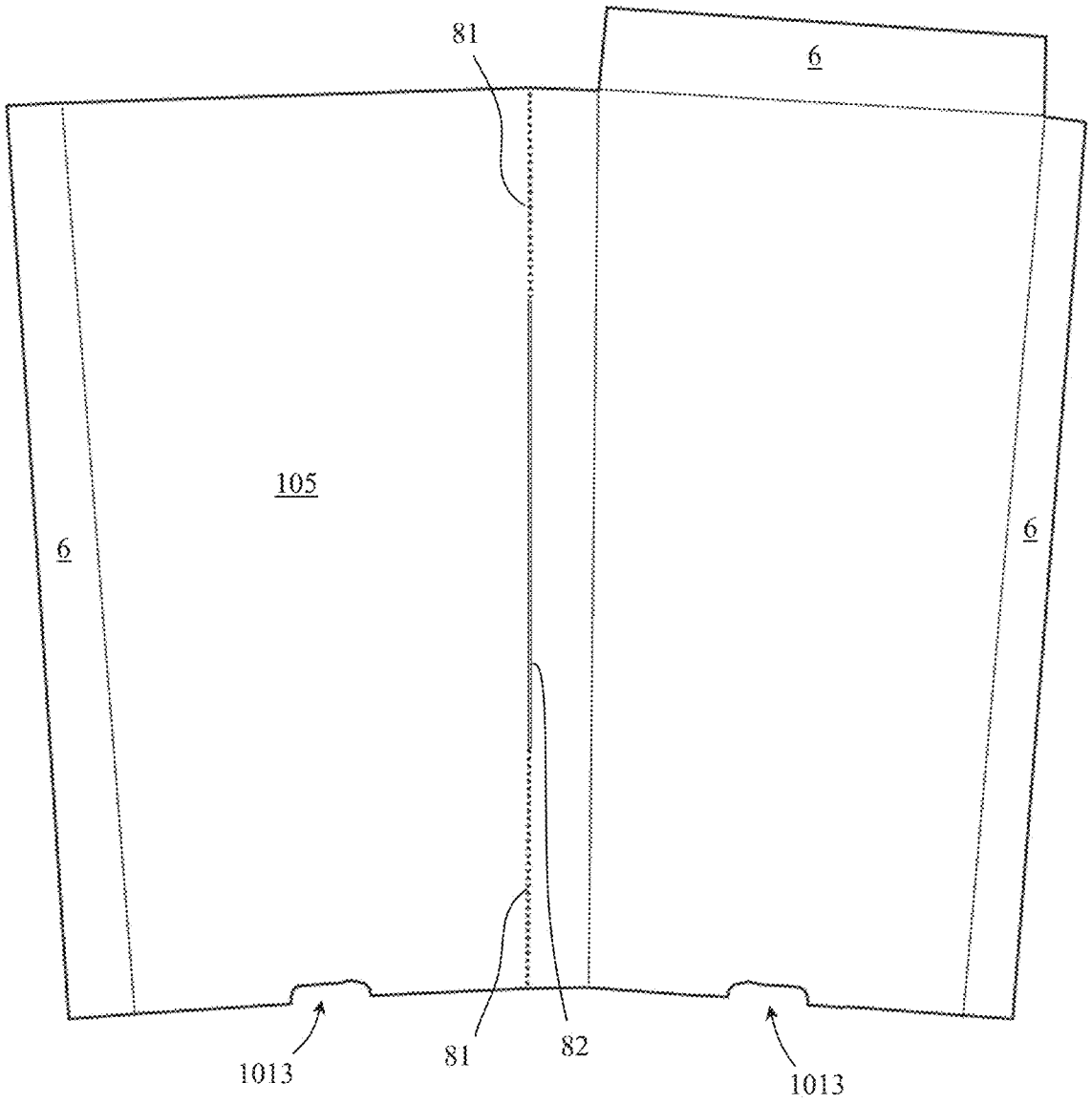
FIGS. 20 and 21 schematically show examples of sheets of material for forming a capsule.

With attention briefly drawn to FIG. 20, another example of a sheet of material 105 for forming a capsule can be seen. Here, several foldable edges 6 can be seen being indicated together with the openings 1013 that are designed to be located at the intended lower region of the capsule. Also seen in this example are possible perforation lines 81 and an optional slit 82 here therebetween that define a 'tearable strip' along the sheet of material 105, which is designed to be more easily torn when an inflated balloon bears upon a capsule formed from such sheet of material from within.

Figure 21:
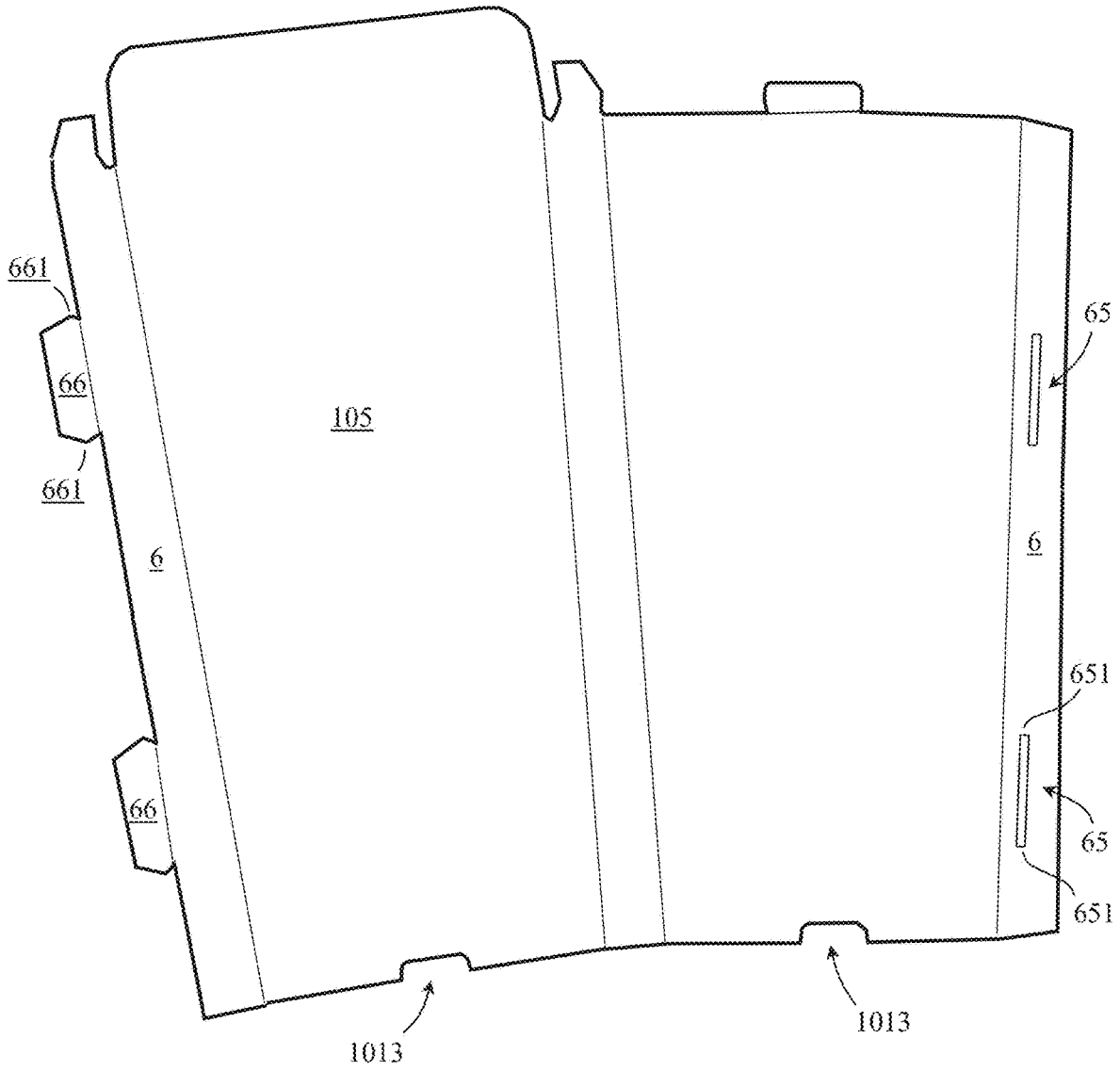

With attention additionally briefly drawn also to FIG. 21, yet another example of a sheet of material 105 for forming a capsule can be seen. Here, locking tabs 66 can be seen extending beyond the sheet of material, e.g. beyond foldable edges 6. These tabs 66, e.g. cut from the sheet of material, may be designed to engage within corresponding slits 65 on the same sheet of material. The locking tabs 66 may be designed to be deliberately wider than the slits 65, so that when inserted into the slits they create a locking mechanism where end tips 661 of the tabs that project beyond the sides 651 of the slits 65, secure the two parts together by preventing the tabs from slipping back out.

Attention is drawn back to FIG. 9A. The ribbon 36 can be seen in this example being attached at one end 1 to the sheet of material 105 possibly via adhesive, while also being attached at its opposing second end 2 to the balloon, in this example by being tied to the balloon's neck region 40 that can be seen in more details in the enlarged section of FIG. 9B.

Figure 9B:
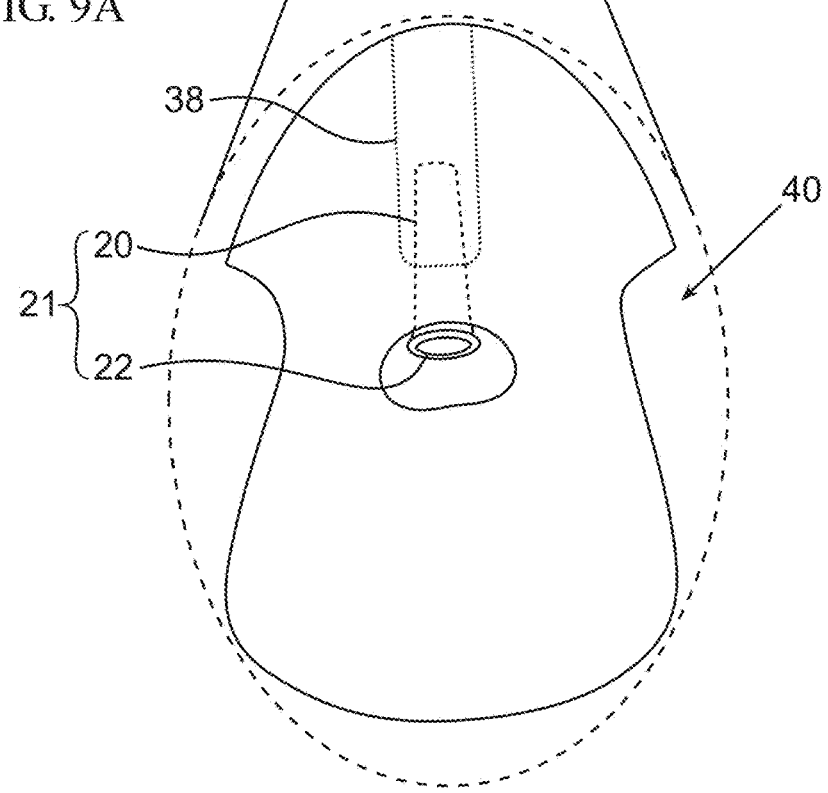
FIG. 9B is an enlarged section of FIG. 9A, showing a neck region of the balloon.

With attention additionally drawn to FIG. 9B, the balloon at its neck region 40 can be seen being fitted with the inflation tube 20 that can here be seen in 'dashed' lines in the region where it is inserted into the balloon. The inflation port 22 of the inflation tube can be seen being left outside of the balloon.

Preferably, at the second end 2 the ribbon 36 is tied upon the inflation tube 20, which is embedded within the balloon's neck region 40 so as to not choke the entry passage for gaseous into the balloon when later inflated.

Also indicated in FIG. 9B by the 'dotted' line marked as 38 is an example of an optional self-sealing valve that may be embedded within the balloon. Such a self-sealing valve, which is e.g. typical to Mylar type balloons, prevents gaseous from escaping once the balloon is inflated, and is usually made from a thin, flexible plastic material. Such self-sealing valve is designed to allow the balloon to be easily inflated and automatically sealed without the need for additional sealing devices. Notably, other types of valves may be used depending on the type of balloon being used.

Figure 18A:
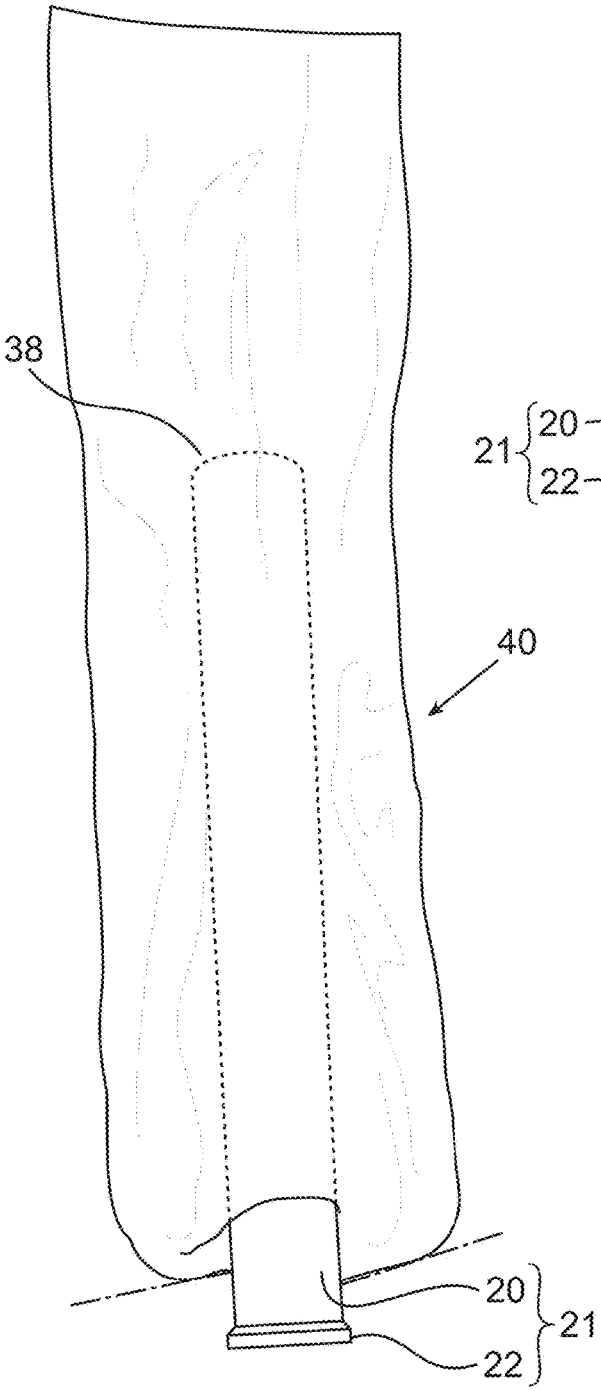
FIGS. 18A to 18C schematically show various valve arrangements for a balloon.

With attention drawn to FIG. 18A, an example of a portion of a self-sealing valve 38 at a balloon's neck region 40 that is fitted with an inflation tube 20 is shown. The inflation tube 20 may be inserted into the self-sealing valve 38 and may be bonded to the self-sealing valve 38 to form an integral part of the balloon.

Figure 18B:
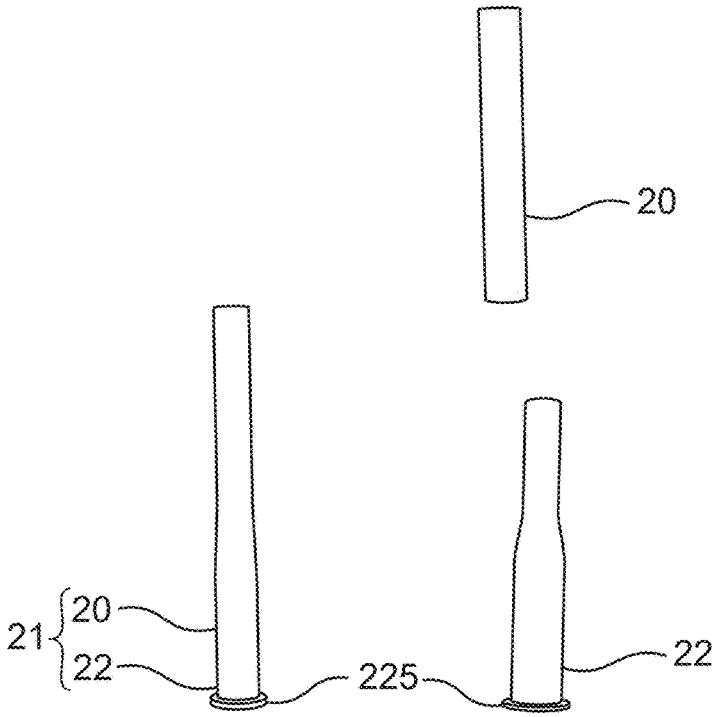
Figure 18C:
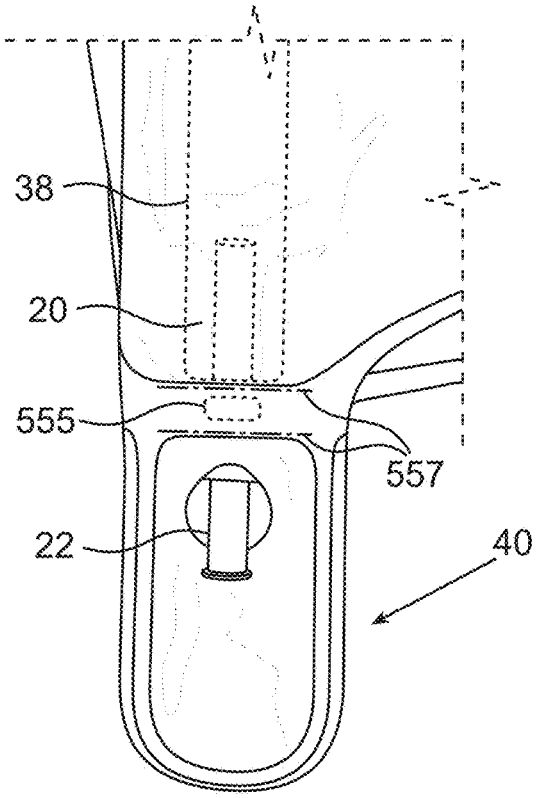

Attention is directed to FIGS. 18B and 18C, which illustrate an example of an inflation stem 21 comprising a flexible inflation tube 20 attached to an inflation port 22. The flexible inflation tube 20 is made from a durable and flexible material, such as polypropylene, allowing it to bend without breaking and withstand moderate heat without deforming.

The inflation stem 21 is formed by securing the inflation tube 20 onto the inflation port 22, ensuring that it's raised rim 222 remains exposed. To insert the inflation stem 21 into the balloon's neck region 40, the raised rim 222 at the distal tip of the inflation port 22 is kept outside the balloon, while the flexible inflation tube 20 is positioned inside the balloon's self-sealing valve 38.

A hot press step may be used to apply heat and pressure to a bond region 555 of the flexible inflation tube 20, located proximally beyond the inflation port 22. This process can bond the inflation tube 20 between the opposing layers of the balloon's self-sealing valve 38, while leaving its internal passage open.

Preferably, the bond region 555 may be positioned within a section of a balloon's weld region 557 as it passes through the balloon's neck region 40. The weld region 557 is a narrow, uniform strip that runs along the entire periphery of the balloon, ensuring a continuous and airtight seal (with exception of the neck region where a small portion in the neck region remains unsealed). This placement of the bond region 555 within the weld region 557 may be advantageous, as the self-sealing valve 38 of the balloon typically substantially begins beyond the weld region 557 within the balloon's neck region 40.

Positioning the flexible inflation tube 20 within the balloon's neck region 40 and self-sealing valve 38 offers advantages, as the tube's flexibility reduces interference with the self-sealing mechanism. This mechanism, commonly used in Mylar-type balloons, functions by overlapping two thin plastic layers to prevent air leakage after inflation. Because the flexible tube is positioned between these overlapping layers, it is less likely to disrupt the sealing process. Additionally, the bond region 555 may create an indentation in the flexible tube 20, forming a bendable section that moves with the balloon's self-sealing valve 38 as it flexes to maintain an airtight seal.

In some cases (not shown), an inflation stem made primarily of a rigid material typical of the inflation port—without a more flexible section like the previously described flexible inflation tube—may be used. In such instances, the rigid inflation stem may preferably be designed to extend into the balloon's neck region without protruding beyond the weld region 557, thereby reducing the risk of interference with the balloon's self-sealing valve 38, which begins beyond the weld region 557.

Figure 19:
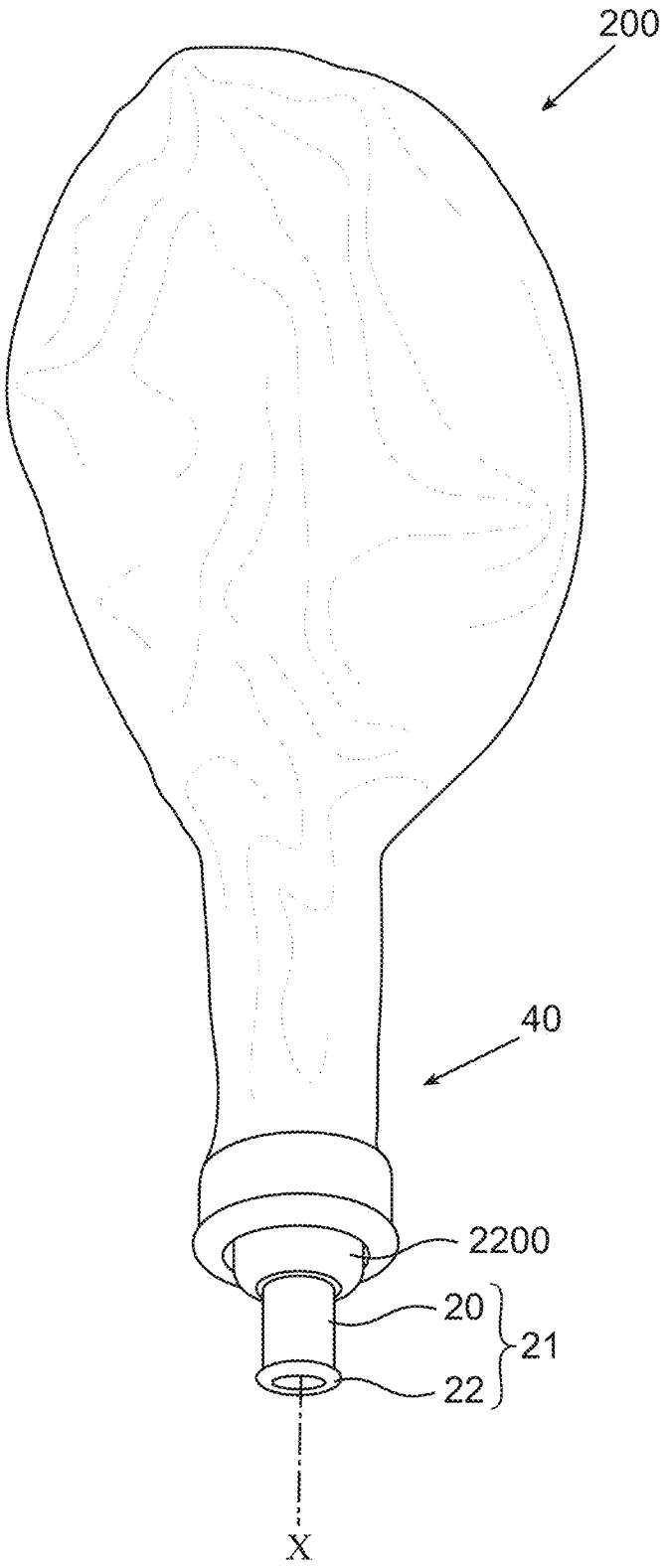
FIG. 19 schematically shows a latex type balloon with an inflation tube attached to an opening in its neck region.

With attention drawn to FIG. 19, a balloon 200 of a different type, here a latex type, can be seen. Here the balloon's neck region 40 can be seen opening out along the balloon's axis X and an inflation tube 20 having a valve 2200 located at an opposing side to its inflation port 22—may urged into the balloon with its valve 2200 leading while the inflation port remains outside of the balloon.

Figure 10:
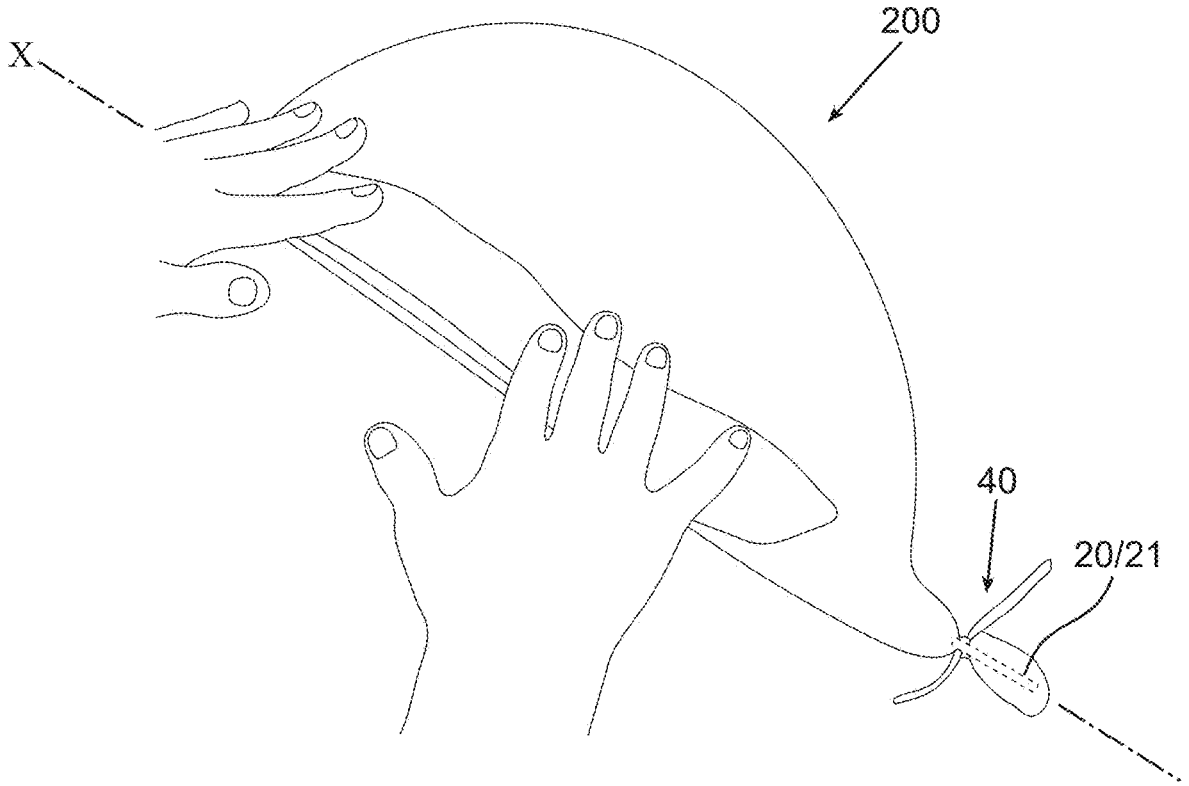
FIG. 10 schematically shows a folding step performed in certain cases to a balloon prior to its assembly into a capsule.

Attention is drawn to FIG. 10 schematically showing a folding step performed in certain cases to a balloon 200 prior to its assembly into a capsule. Such a folding step may be required for a balloon e.g. of a Mylar type while less or not at all required for a balloon e.g. of a latex type (see FIG. 19), which is typically smaller and may be fitted onto the sheet of material 105 of the capsule without need of much or any folding.

In such a folding step, the balloon in its deflated state may initially be spread out evenly flat upon a planar surface and then folded along fold lines that are generally parallel to an axis X that is defined by the balloon's neck region 40 and hence by the tube 20 that is embedded within this region.

Once completing this folding step, the balloon may be folded along fold lines generally perpendicular to axis X, while in cases where the internal valve is a self-sealing valve made from thin, flexible plastic material (such as in the case of Mylar balloons), preferably avoiding folding along lines that intersect the self-sealing valve.

Figure 11:
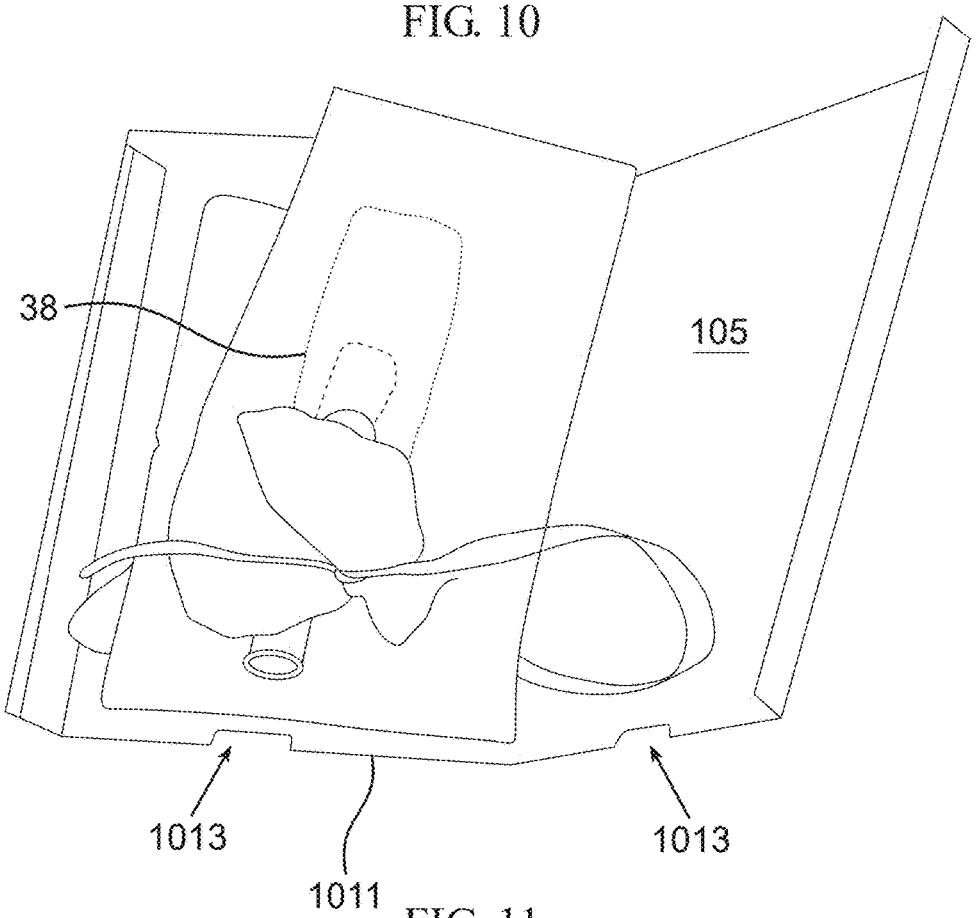
FIG. 11 schematically shows a balloon in its folded state placed upon an inner side of a sheet of material of the capsule.

In FIG. 11 the folded balloon can be seen being placed upon the sheet of material 105 of the capsule with the openings 1013 within the (to be) capsule's lower boundary region 1011 being also visible.

Figure 12:
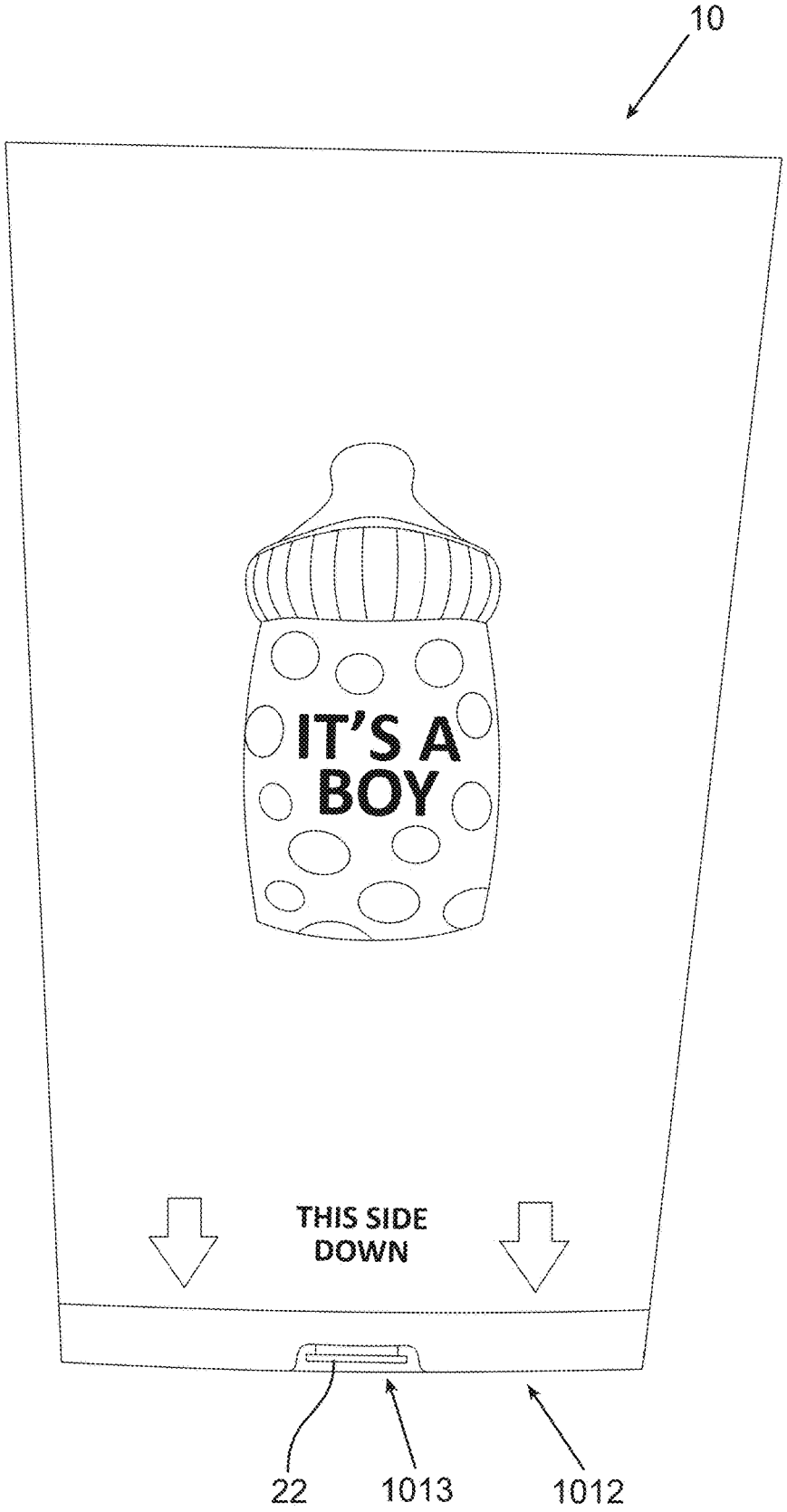
FIG. 12 schematically shows a side view of an embodiment of a capsuled balloon.

In FIG. 12 the capsuled balloon 10 can be seen after the capsule's sheet of material has been folded upon the folded balloon 200 to form a capsule 101 within which the balloon is housed.

It is noted that anchor means may be provided to assist in maintaining the capsuled balloon within the interface 16 in its desired location-after the interface's boundary 161 and reference face 162 engaged and interacted with the capsuled balloon's boundary region 1011 to suitably locate the capsuled balloon in such a desired location.

Such anchor means may be embodied as magnets located on the interface 16 that interact with metallic material formed at the capsule's lower terminal face 62 at its lower side 1012 in order to provide such initial attachment between the capsule and interface.

Figure 13A:
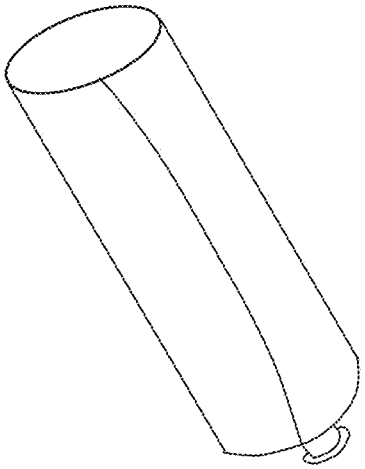
FIGS. 13A to 13C schematically show various views of another embodiment of a capsuled balloon, in this example being generally cylindrically in form.
Figure 13B:
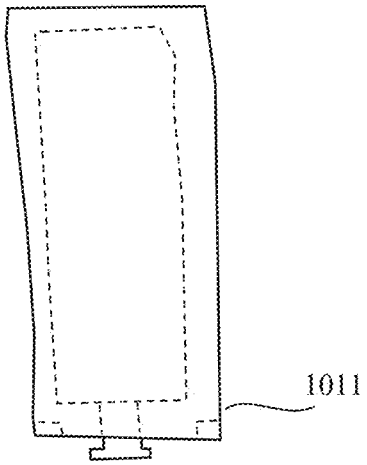
Figure 13C:
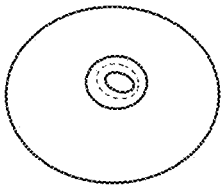

With attention drawn to FIGS. 13A to 13C an embodiment of a capsuled balloon having cylindrical form can see seen, resulting in the lower boundary region 1011 of the capsule being generally cylindrical. Here the capsule is formed by rolling the sheet of material into a cylindrical form and attaching the opposing longitudinal edges of the sheet one to the other. As a result, a reference face 162 of an interface 16 of an inflation device that is suited to receive such a cylindrical capsuled balloon may be formed to be generally cylindrical too.

Figure 14A:
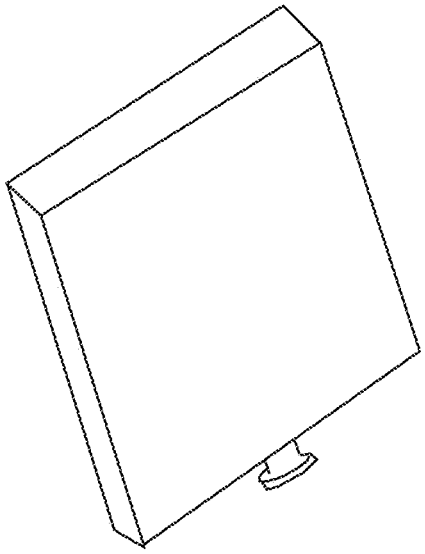
FIGS. 14A to 14C schematically show various views of yet another embodiment of a capsuled balloon, in this example having a general shape of a narrow rectangular prism.
Figure 14B:
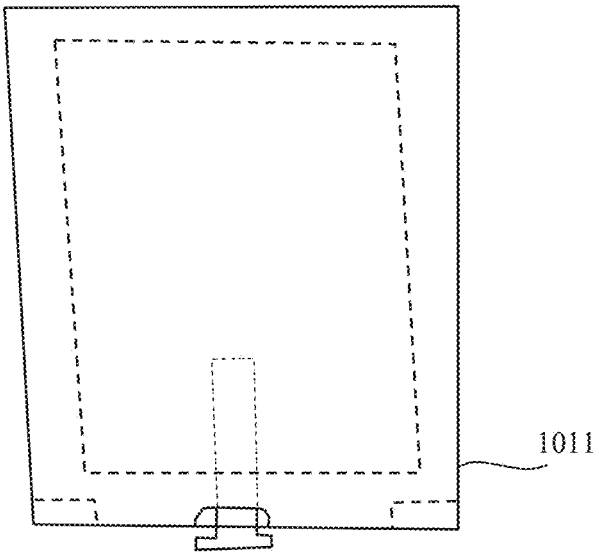
Figure 14C:
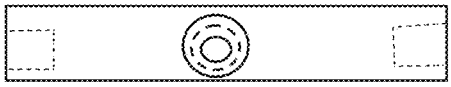

With attention drawn to FIGS. 14A to 14C an embodiment of a capsuled balloon having narrow rectangular prism form can see seen, resulting in the lower boundary region 1011 of the capsule being generally prism shaped. As a result, a reference face 162 of an interface 16 of an inflation device that is suited to receive such a prism shaped capsuled balloon may be formed to be generally similarly prism shaped too.

Figure 15A:
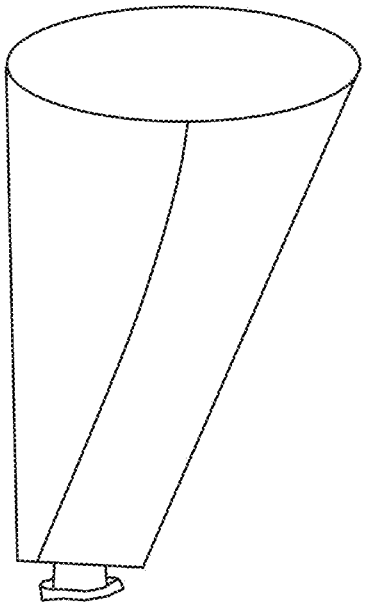
FIGS. 15A to 15C schematically show various views of yet a further other embodiment of a capsuled balloon, in this example being generally cone shaped.
Figure 15B:
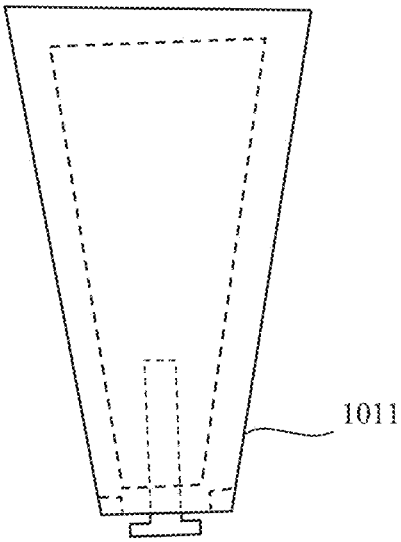
Figure 15C:
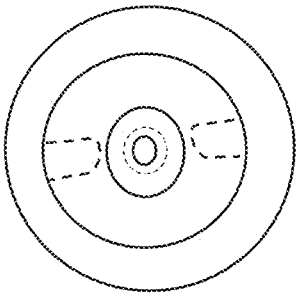

With attention drawn to FIGS. 15A to 15C an embodiment of a generally cone shaped capsuled balloon can be seen, resulting in the lower boundary region 1011 of the capsule being generally cone shaped. Here the capsule is formed by rolling the sheet of material into a conical shape and attaching the opposing longitudinal edges of the sheet one to the other. As a result, a reference face 162 of an interface 16 of an inflation device that is suited to receive such a cone shaped capsuled balloon may be formed to be generally cone shaped too.

Figure 16:
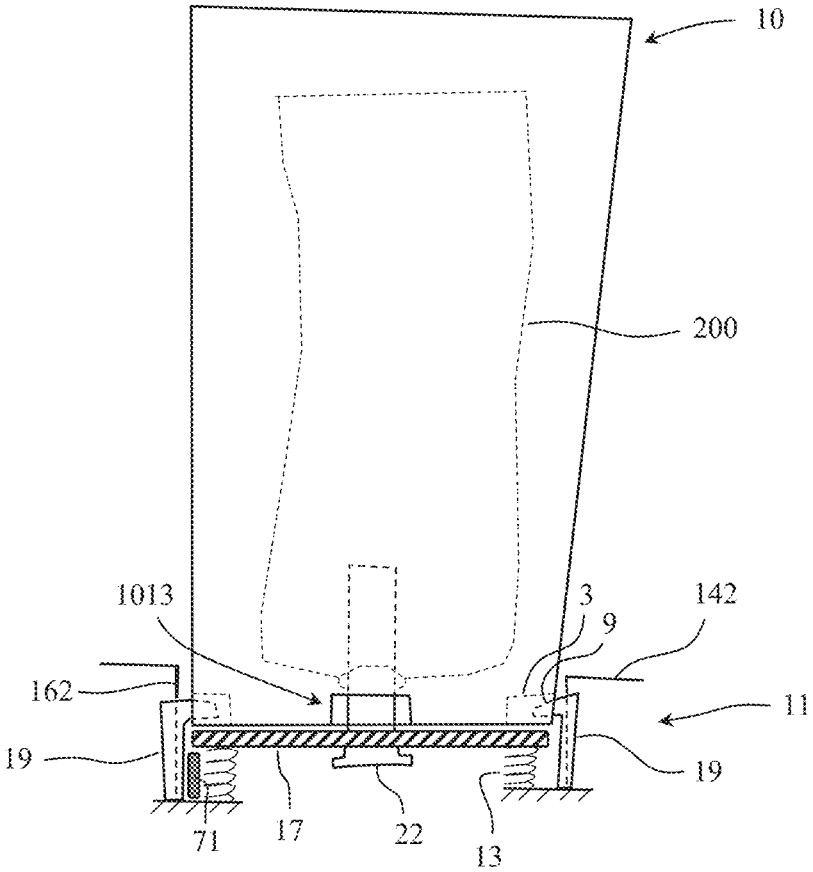
FIG. 16 schematically shows an embodiment of a capsuled balloon in an engaged state with an embodiment of an inflation device that includes a loading mechanism at its interface.
Figure 17:
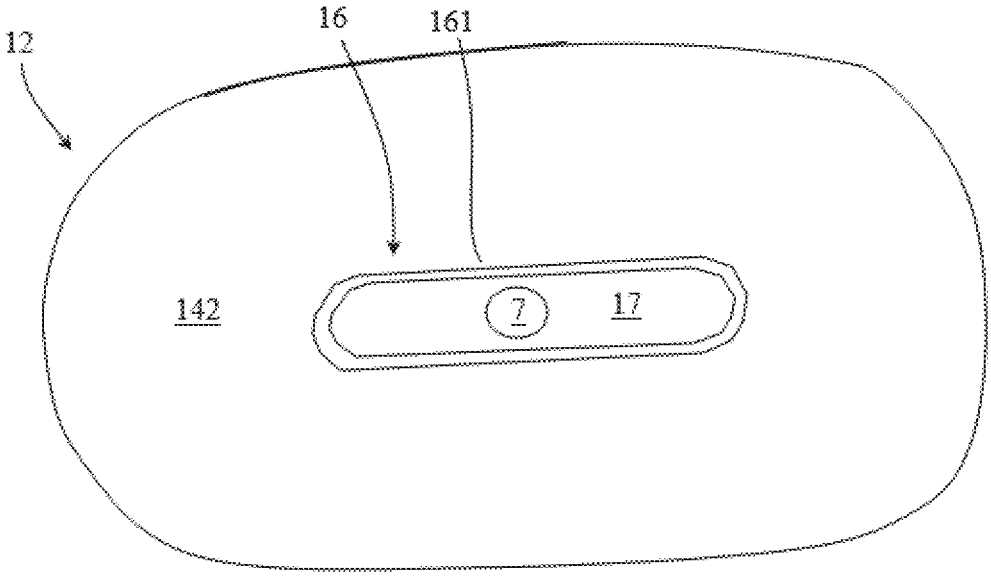
FIG. 17 schematically shows a top view of the inflation device of FIG. 16.

Attention is drawn to FIGS. 16 and 17 schematically showing an embodiment of a capsuled balloon 10 in an engaged state with an embodiment of an inflation device 12 that includes a loading mechanism 11 at its interface 16.

In an aspect of the present invention, such a loading mechanism utilizes an initial step of pressing the capsuled balloon against a spring loaded lid 17 in order to trigger one or more additional events in a certain order, which simplifies the phase of inflating the capsuled balloon and activating its release from the capsule.

In the example shown, engaging the capsuled balloon 10 with the loading mechanism 11 is initially adapted to trigger alignment of the capsuled balloon within the interface 16 through interaction between the capsule's lower boundary region 1011 and the interface's reference face 162. The anchoring means that are designed to maintain the capsule in its desired orientation/location within the interface 16, are embodied here as anchoring arms 19.

The loading mechanism 11 accordingly includes a lid 17 that is held in an upward position by springs 13. The lid 17 includes a central hole 7 and the springs 13 maintain the lid generally flush with the top part 142 of the inflation device when not engaged.

Initial loading of the loading mechanism may be accordingly accomplished by first engaging the lid 17 with the lower side of the capsuled balloon while placing the balloon's inflation port 22 within hole 7.

By then pressing the capsuled balloon 10 downwards, a further step of loading the loading mechanism may be accomplished by urging the lid 17 downwards to flex the anchoring arms outwards until they are permitted to snap back inwards into the position seen in FIG. 16 (i.e. after the lid passed the anchoring arms) where they protrude into the interface's cavity through apertures in the reference face 162.

Here the tips 9 of the anchoring arms 19 engage with respective side openings 3 formed adjacent the lower side of the capsule in order to anchor the capsuled balloon in a desired position within the inflation device's interface 16.

Such anchoring may assist in maintaining the openings 1013 within the capsule in the correct position for the locking arms 18 (not shown) to enter and engage with the inflation tube 20 in order to secure it in place—so that a subsequent inflation phase of the balloon may be performed as seen and discussed with respect to FIGS. 7 and 8.

In an embodiment of the loading mechanism 11, as the lid 17 reaches the position where the anchoring arms 19 engage with the capsule's side openings 3—a subsequent event may be activated in which the locking arms 18 are urged to engage the inflation tube 20 and secure it in place. Such activation may e.g. be activated via a micro switch 71 that the lid 17 engages.

Possibly, once the locking arms 18 fix the inflation tube 20 in place, an additional subsequent event may be activated in which the inflation nozzle 30 is biased to engage the inflation port 22 and inflation of the balloon is performed.

Attention is drawn to FIGS. 25A to 25D, showing yet another example of a sheet of material 105 for forming a capsule in accordance with the present disclosure. The sheet of material 5 includes a first base flap 501 and a second auxiliary flap 502 that is connected to the base flap via a lateral extending interconnecting flap 61. The sheet of material includes also a leading section 503 that is connected via a lateral extending terminal flap 62 to the base flap 501.

An opening 72 formed within terminal flap 62 is configured to serve as an opening through which the inflation tube 20 extends in the capsuled balloon (as seen e.g. in the enlarged section of FIG. 3), and hence the terminal flap 62 is configured to serve as the capsule's lower side 1012.

Figure 25A:
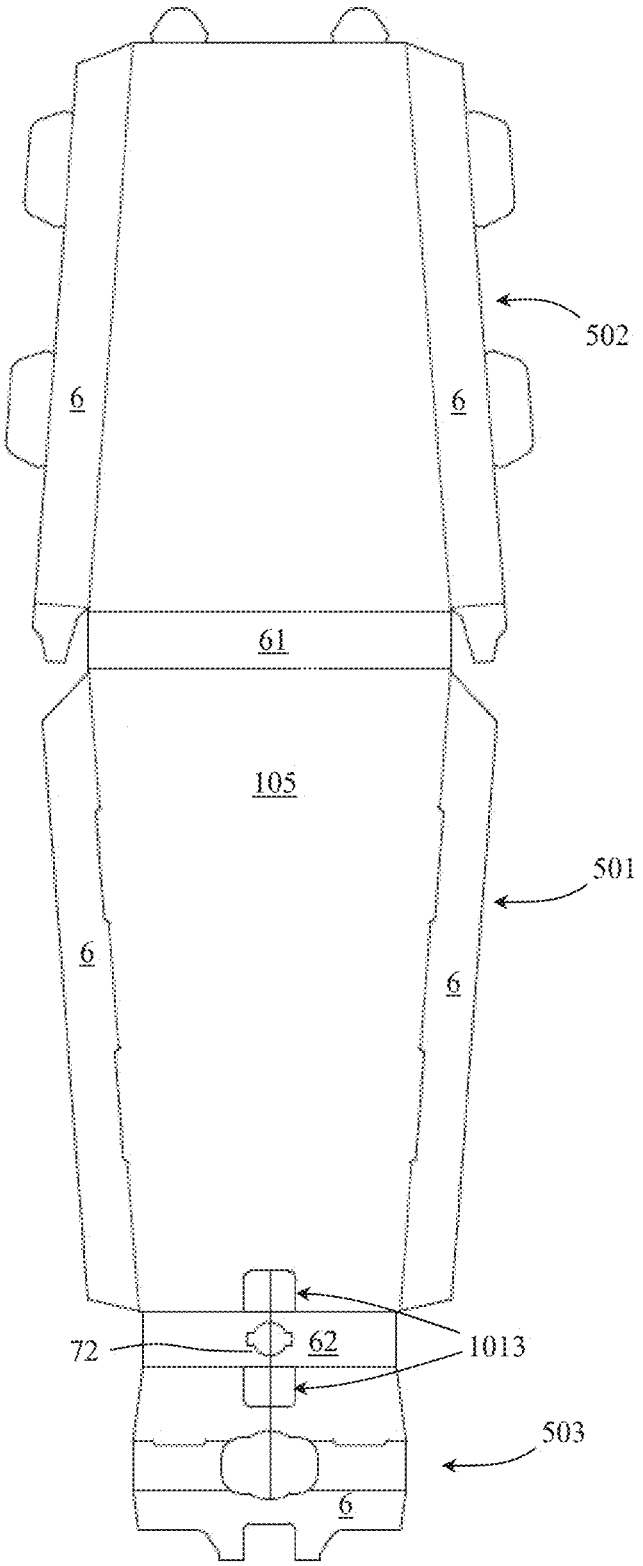
FIGS. 25A to 25E schematically show further examples of sheets of material for forming a capsule or capsuled balloon.
Figure 25B:
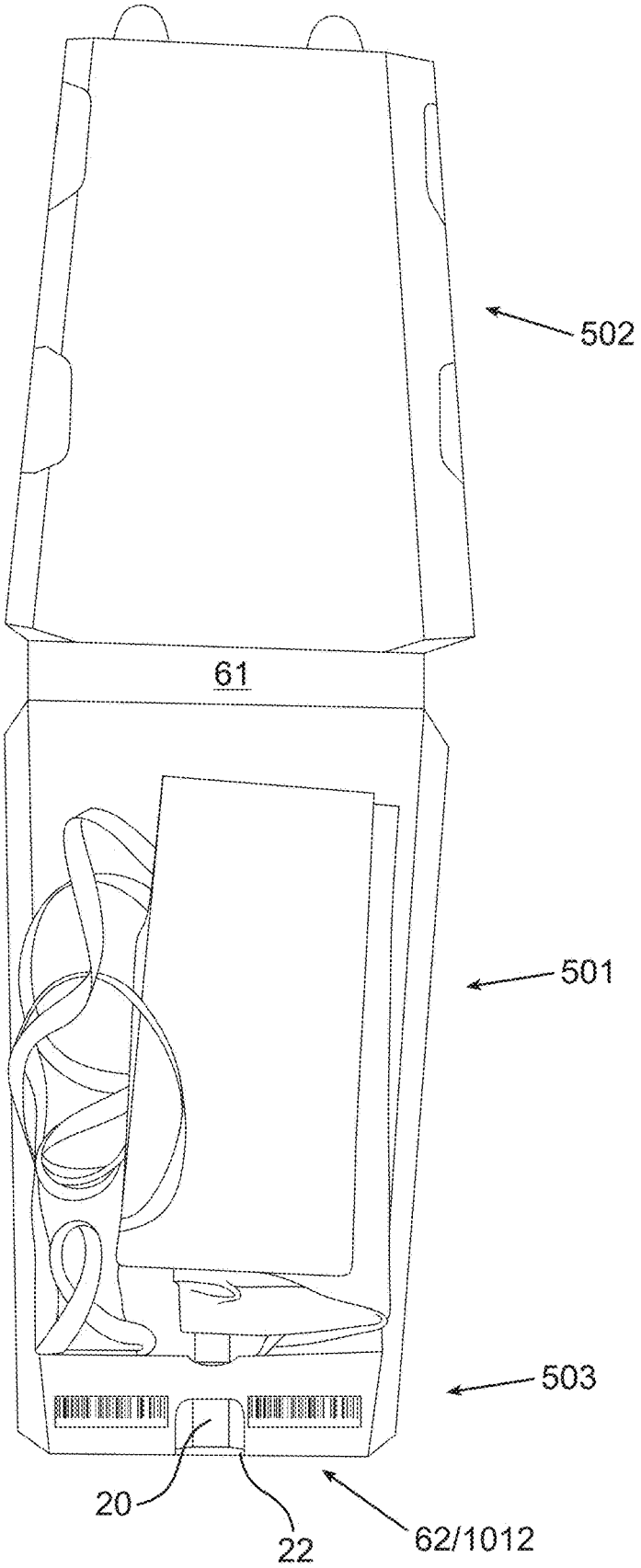
Figure 25C:
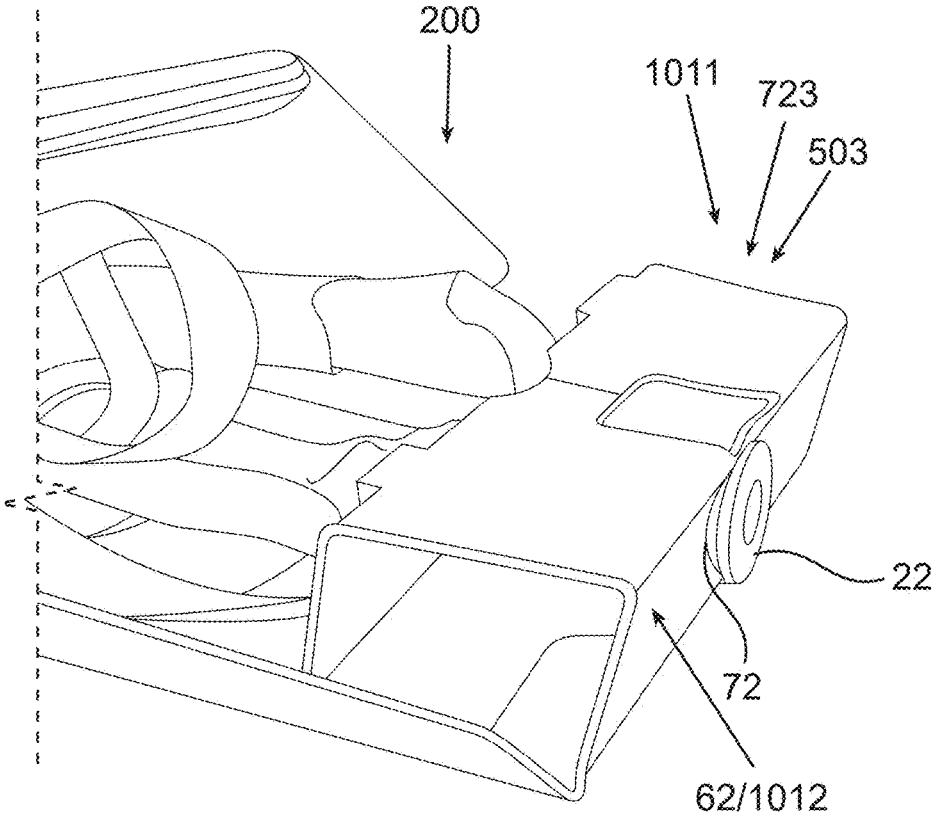
Figure 25D:
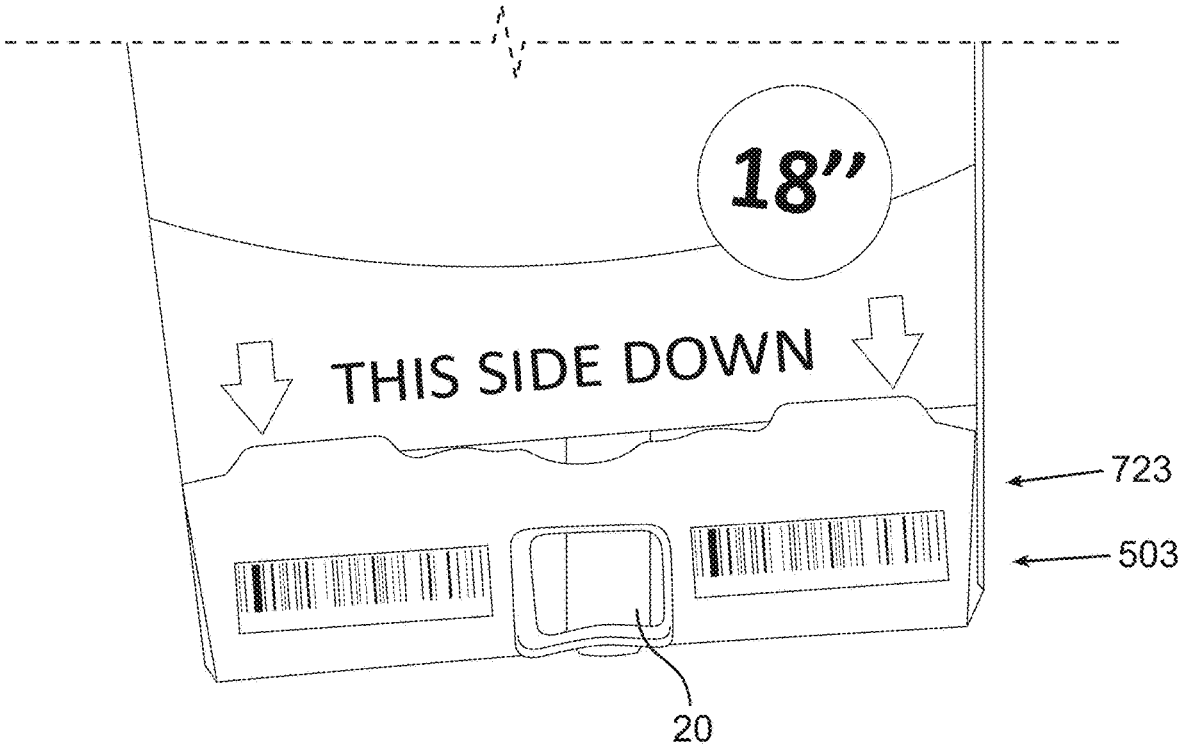
Figure 25E:
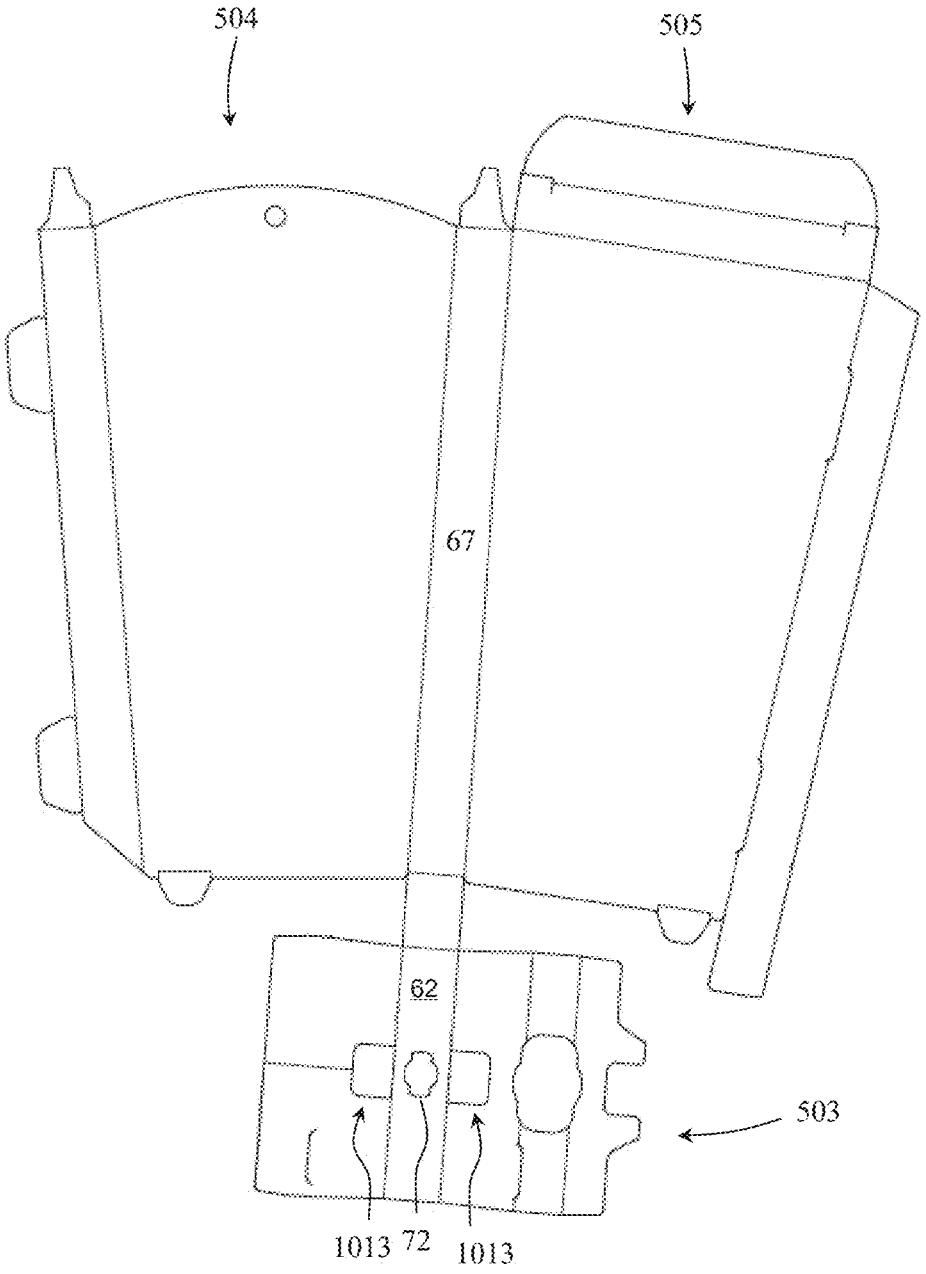

As best seen in FIG. 25C, the leading section 503 when folded back towards the base flap 501 forms a retaining interface 723 at the lower boundary region 1011 of the capsule. The retaining interface 723 is interposed between the folded balloon 200 and the raised rim 222 of the inflation port 22, with the balloon pressing against inner side of the retaining interface while the raised rim 222 is secured on the opposite outer side within opening 72, possibly without need of any adhesives to keep the inflation tube in place. This configuration ensures that the inflation port remains securely fixed within the retaining interface while allowing controlled inflation of the balloon. FIG. 25E illustrates a variation of the sheet of material depicted in FIGS. 25A to 25D, where the capsule in this example is composed of two lateral sections, 504 and 505. These sections fold relative to each other over an axially extending flap 67, similar to the way a book closes. The sheet of material in this example includes also a leading section 503 similar to the one in the previous example, which when folded onto itself forms a retaining interface 723 at the lower boundary region 1011 of the capsule, which includes the lower terminal face 62 at the capsule's lower side 1012.

Figure 26A:
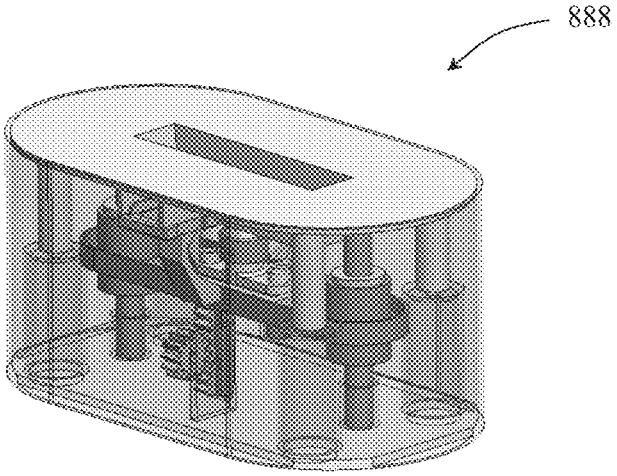
FIGS. 26A and 26B schematically illustrate an embodiment of a standalone modular configuration of an Inflation Handling System (HIS) of the present invention, which includes components used for inflating capsuled balloons.
Figure 26B:
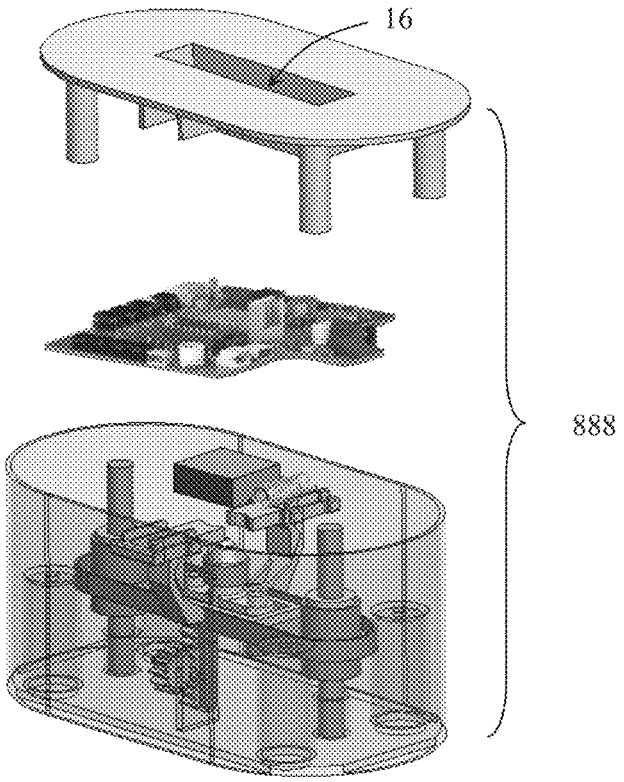

Attention is drawn to FIGS. 26A and 26B schematically illustrating an embodiment of a standalone modular configuration 888 of an Inflation Handling System (HIS) of the present invention, which includes components used for inflating capsuled balloons.

As seen, this standalone modular configuration 888 of the HIS includes an upper top in which the HIS's interface 16 is formed, and components involved in inflating capsuled balloons—including the inflation device's locking arms, fluid delivery conduits, controllers, actuators (and the like).

Figure 27:
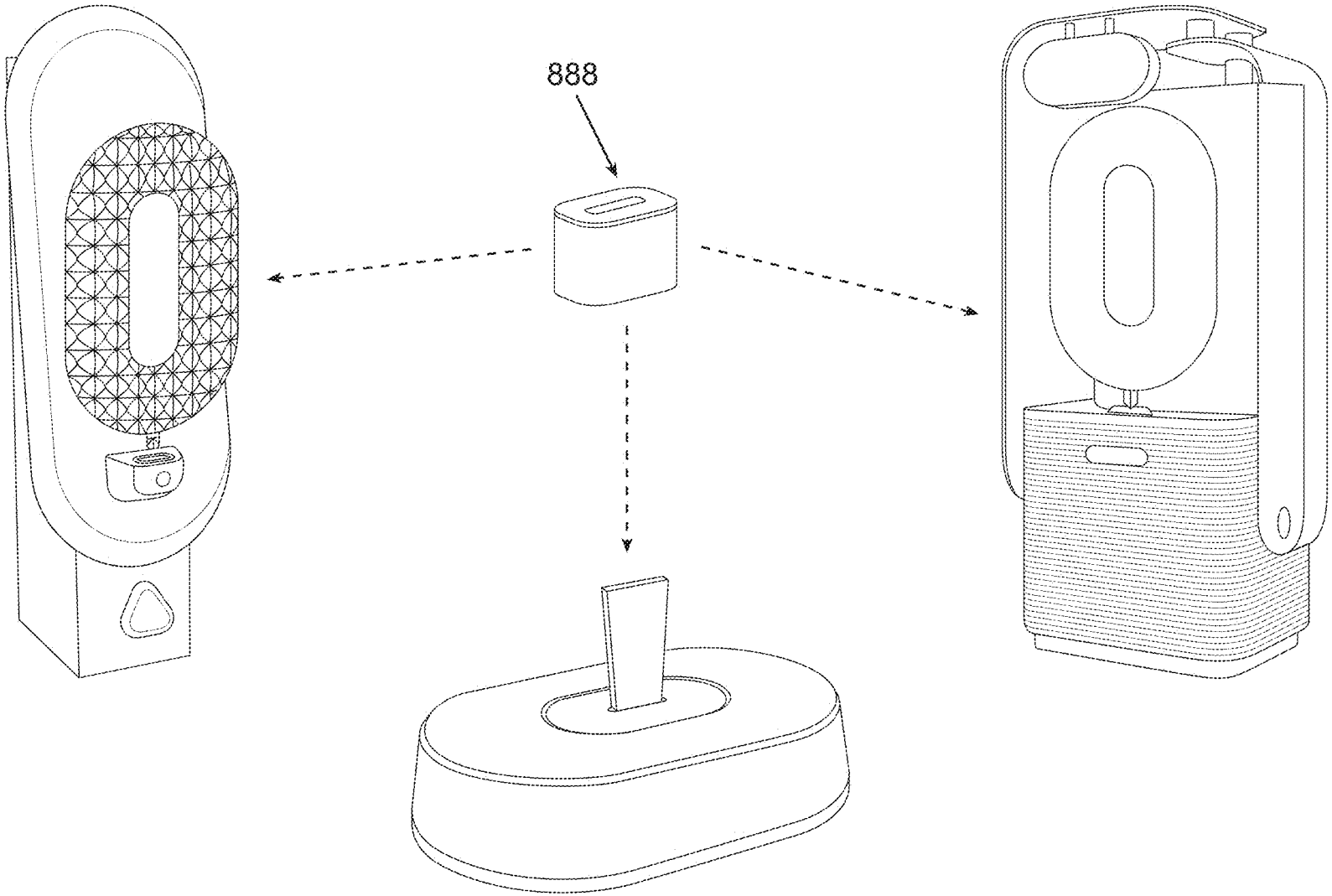
FIG. 27 schematically depicts various types of inflation devices in which the Inflation Handling System (HIS) of the present disclosure may be incorporated and integrated to enable functionality of inflating capsuled balloons.

In an aspect of the present disclosure, as depicted in FIG. 27, the modular configuration 888 of the HIS may be incorporated and integrated into various platforms, such as the desktop inflation device seen in former figures of this disclosure and also other types of platforms, such as self-service kiosks here depicted.

Figure 28:
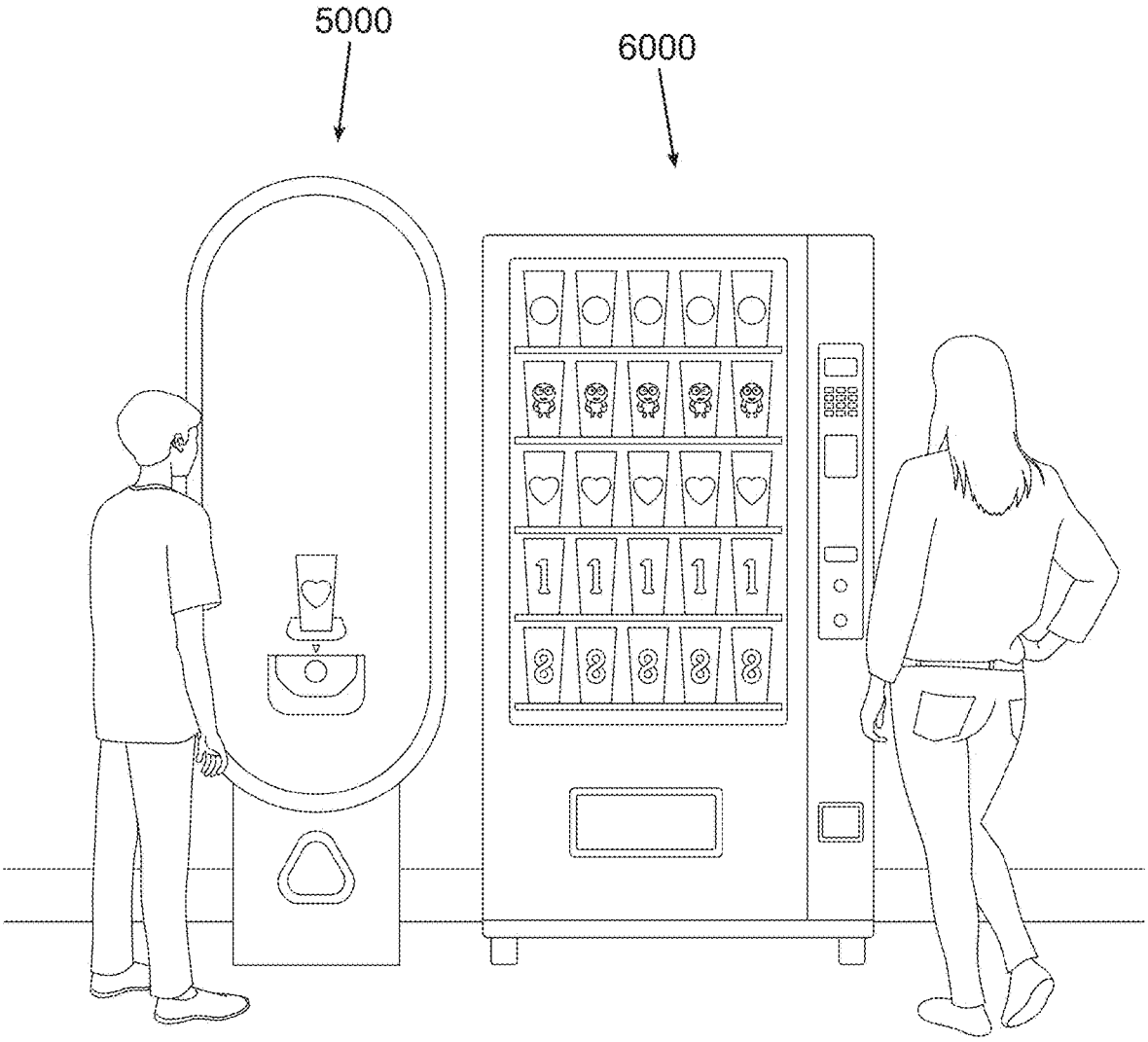
FIG. 28 schematically illustrates an embodiment of an inflation device designed as a self-service kiosk, positioned next to a vending machine for capsuled balloons, which can be inflated using the kiosk's inflation device.

Attention is drawn to FIG. 28 schematically illustrating an embodiment of an inflation device 5000 designed as a self-service kiosk, positioned next to a vending machine 6000 for capsuled balloons, which can be inflated using the kiosk's inflation device 5000.

In certain cases, the inflation device 5000 may be configured to only inflate capsuled balloons distributed by the vending machine 6000 associated therewith, possibly via a communication channel, either wired or wireless communication.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Further more, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures can not be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A method for forming a capsuled balloon comprising the steps of:

providing a sheet of material, providing a balloon comprising a neck region, and providing an inflation stem, wherein the capsuled balloon is formed by:

placing a first portion of the inflation stem within the neck region while leaving a second portion thereof exposed outside of the balloon, and placing the balloon upon the sheet of material, and then urging the sheet of material to form a capsule that substantially encloses the balloon therein while leaving at least a tip of the inflation stem's second portion exposed to outside of the capsule, wherein urging the sheet of material to form a capsule comprises folding the sheet of material onto itself along several fold lines.

2. The method of claim 1, wherein urging the sheet of material to form a capsule comprises rolling the sheet of material onto itself.

3. The method of claim 1, wherein at least some of the several fold lines are generally parallel one to the other.

4. The method of claim 1, wherein placing the balloon upon the sheet of material comprises first folding the balloon.

5. The method of claim 4, wherein folding the balloon comprises initially spreading it out and then folding it first along fold lines that are generally parallel to an axis X that is defined by the balloon's neck region and the inflation stem that is located within the neck region.

6. The method of claim 5, wherein the balloon comprises a self-sealing valve made from thin flexible plastic material and folding the balloon further comprises folding along lines that are generally perpendicular to axis X while avoiding folding along lines that intersect the self-sealing valve.

7. The method of claim 1, wherein the balloon comprises a self-sealing valve comprising two thin plastic layers, and placing the first portion of the inflation stem within the neck region comprises placing it in between the two thin plastic layers.

8. The method of claim 7, wherein the inflation stem comprises an inflation tube and an inflation port, wherein the first portion of the inflation stem is comprised in the inflation tube and the second portion of the inflation stem is comprised in the inflation port.

9. The method of claim 8, wherein the inflation tube and the inflation port are different parts.

10. The method of claim 9, wherein the inflation tube is made from flexible material, such as polypropylene.

11. A capsuled balloon comprising a capsule and a balloon, the capsule being formed from a sheet of material that is folded or rolled onto itself, the balloon comprising a neck region and an inflation stem at least partially located within the neck region, wherein in the capsuled balloon the balloon is substantially encased within the capsule while leaving at least a tip of the inflation stem exposed to outside of the capsule through an opening formed in a lower terminal face of the capsule, and wherein the lower terminal face is comprised in a lower boundary region of the capsule and the capsule comprises at least one lateral extending opening formed at the lower boundary region above the lower terminal face for providing lateral access towards the inflation stem.

12. The capsuled balloon of claim 11, wherein the balloon comprises a self-sealing valve comprising two thin plastic layers, and placing the at least portion of the inflation stem within the neck region comprises placing it in between the two thin plastic layers.

13. The capsuled balloon of claim 12, wherein the inflation stem comprises an inflation tube and an inflation port, wherein the at least portion of the inflation stem within the neck region is comprised in the inflation tube and the tip of the inflation stem is comprised in the inflation port.

14. The capsuled balloon of claim 13, wherein the inflation tube and the inflation port are made from different materials.

15. The capsuled balloon of claim 14, wherein the inflation tube is made from a material that is more flexible than the material of inflation port.

16. The capsuled balloon of claim 11 and having a generally narrow rectangular prism shape comprising opposing narrow end faces.

17. The capsuled balloon of claim 16, wherein one of the end faces is smaller than the other end face imparting a tapering shape to the capsuled balloon.

18. The capsuled balloon of claim 16, wherein at least the tip of the inflation stem is exposed at one of the end faces that constitutes the lower terminal face of the capsule.

19. A method for using a capsuled balloon comprising the steps of:

providing a capsule formed from a folded or rolled sheet of material, providing a balloon with a neck region and an inflation stem at least partially within the neck region, wherein the balloon is substantially enclosed within the capsule with at least a tip of the inflation stem remaining exposed to outside of the capsule at a lower terminal face of the capsule, and then inflating the balloon via the exposed tip of the inflation stem to a fully inflated state, wherein the capsule being formed from paper-based material having a generally narrow rectangular prism shape comprising opposing narrow end faces and one of the narrow end faces constituting the lower terminal face.

20. The method of claim 19, wherein in the fully inflated state at least part of the capsule is torn open.

21. The method of claim 19, wherein upon inflation the balloon is adapted to 'pop', 'burst' and/or 'break' open the capsule so that it can be freed to exit the capsule.

22. The method of claim 20, wherein upon inflation the balloon is adapted to 'pop', 'burst' and/or 'break' open the capsule so that it can be freed to exit the capsule.

* * * * *